US011363917B2

(12) United States Patent
Yoshida et al.

(10) Patent No.: US 11,363,917 B2
(45) Date of Patent: Jun. 21, 2022

(54) TOILET PAPER

(71) Applicant: DAIO PAPER CORPORATION, Ehime (JP)

(72) Inventors: Shohei Yoshida, Shizuoka (JP); Shinichi Warashina, Shizuoka (JP)

(73) Assignee: DAIO PAPER CORPORATION, Ehime (JP)

( * ) Notice: Subject to any disclaimer, the term of this patent is extended or adjusted under 35 U.S.C. 154(b) by 7 days.

(21) Appl. No.: 16/626,431

(22) PCT Filed: Jun. 26, 2018

(86) PCT No.: PCT/JP2018/024235
§ 371 (c)(1),
(2) Date: Dec. 24, 2019

(87) PCT Pub. No.: WO2019/004225
PCT Pub. Date: Jan. 3, 2019

(65) Prior Publication Data

US 2020/0129012 A1 Apr. 30, 2020

(30) Foreign Application Priority Data

Jun. 30, 2017 (JP) ..... JP2017-128581

(51) Int. Cl.
*A47K 10/16* (2006.01)
*D21H 27/30* (2006.01)
*B31F 1/07* (2006.01)

(52) U.S. Cl.
CPC ..... *A47K 10/16* (2013.01); *D21H 27/30* (2013.01); *B31F 1/07* (2013.01); *Y10T 428/24463* (2015.01)

(58) Field of Classification Search
CPC ..... A47K 10/16; D21H 27/30; D21H 27/02; D21H 27/002; D21H 27/40; B31F 1/07; B31F 2201/0733; B31F 2201/07; B31F 2201/0761; B31F 2201/0764; Y10T 428/24455; Y10T 428/24463
See application file for complete search history.

(56) References Cited

U.S. PATENT DOCUMENTS 4,671,983 A 6/1987 Burt
6,277,466 B1 * 8/2001 McNeil ..... D21H 27/40 428/154

(Continued)

FOREIGN PATENT DOCUMENTS

EP 1428654 A1 * 6/2004 ..... B31F 1/07
JP H06-028951 4/1994

(Continued)

OTHER PUBLICATIONS

Translation of JP2017064191. (Year: 2017).*

(Continued)

*Primary Examiner* — Catherine A. Simone
(74) *Attorney, Agent, or Firm* — IPUSA, PLLC

(57) ABSTRACT

Toilet paper includes a first sheet on which first embossments are formed and a second sheet on which second embossments are formed. The first sheet and the second sheet are joined together in a nested manner, and at least some embossments in one of the first embossments and the second embossments are arranged on a first curve having a sine-wave shape.

12 Claims, 13 Drawing Sheets

(56) References Cited

U.S. PATENT DOCUMENTS

| | | | | |
|---|---|---|---|---|
| 2004/0200590 | A1* | 10/2004 | Wilhelm | B31F 1/07 162/118 |
| 2004/0234805 | A1 | 11/2004 | Hirasawa et al. | |
| 2009/0226670 | A1 | 9/2009 | Schutz | |
| 2013/0344294 | A1* | 12/2013 | Eilert | B32B 29/08 428/172 |

FOREIGN PATENT DOCUMENTS

| | | |
|---|---|---|
| JP | H11-505297 | 5/1999 |
| JP | 2003-070678 | 3/2003 |
| JP | 2003-199687 | 7/2003 |
| JP | 2005-287725 | 10/2005 |
| JP | 2006-045690 | 2/2006 |
| JP | 2006-280616 | 10/2006 |
| JP | 2006-524093 | 10/2006 |
| JP | 2009-528928 | 8/2009 |
| JP | 4533806 | 9/2010 |
| JP | 6317995 | 10/2013 |
| JP | 6021532 | 11/2016 |
| JP | 2016-202855 | 12/2016 |
| JP | 2017-064191 | 4/2017 |
| WO | 96/034149 | 10/1996 |

OTHER PUBLICATIONS

Japanese Office Action for 2018-563184 dated Mar. 17, 2020.
International Search Report dated Sep. 11, 2018 with respect to PCT/JP2018/024235 filed on Jun. 26, 2018.
Office Action dated Sep. 20, 2019 issued with respect to the corresponding Japanese Patent Application No. 2018-563184.
Extended European Search Report for 18823305.0 dated Feb. 8, 2021.

* cited by examiner

TOILET PAPER

TECHNICAL FIELD

The present invention relates to toilet paper.

BACKGROUND ART

Known toilet paper has a structure in which multiple sheets of embossed base paper are stacked on each other. Also, due to widespread use of shower toilets, durability (strength) and high water absorbency are now required for toilet paper.

For example, Japanese Patent No. 6,021,532 (Patent Document 1) discloses toilet paper having a laminated structure called a design laminate. A design is added to this toilet paper by bonding sheets of base paper together using an adhesive including a pigment component.

Also, Japanese Laid-Open Patent Publication No. H06-028951 (Patent Document 2) discloses toilet paper having a tip-to-tip laminated structure. In this toilet paper, as illustrated in FIGS. 6 through 8, a space is formed between two sheets of base paper (crepe paper 10 and crepe paper 20) by bonding top parts (top parts 33 and 43) of embossed protrusions (embossed protrusions 32 and 42) to each other such that parts where no embossed protrusion is formed (non-embossed parts 11 and 21) face each other.

RELATED-ART DOCUMENTS

Patent Documents

Patent Document 1

Japanese Patent No. 6021532

Patent Document 2

Japanese Laid-Open Patent Publication No. H06-028951

DISCLOSURE OF INVENTION

Problems to be Solved by the Invention

However, with the configuration of the related-art toilet paper having a design, the sheets of base paper are merely bonded to each other at bonded portions, and therefore the toilet paper is not sufficiently strong. Also, because sufficient space is not formed between the sheets of base paper, the water absorbency of the toilet paper is limited. Also, with the configuration of the toilet paper having a tip-to-tip laminated structure, because a large space is formed between the sheets of base paper, the toilet paper tends to be flattened easily in the thickness direction and cannot sufficiently retain absorbed water. Thus, the strength and the water absorbency of the related-art toilet paper are not necessarily high.

One object of the present invention is to provide toilet paper having improved strength and water absorbency.

Means for Solving the Problems

An aspect of the present invention provides toilet paper that includes a first sheet on which first embossments are formed and a second sheet on which second embossments are formed. The first sheet and the second sheet are joined together in a nested manner, and at least some embossments in one of the first embossments and the second embossments are arranged on a first curve having a sine-wave shape.

Advantageous Effect of the Invention

An aspect of the present invention makes it possible to provide toilet paper having improved strength and water absorbency.

DESCRIPTION OF EMBODIMENTS

Figure 1:
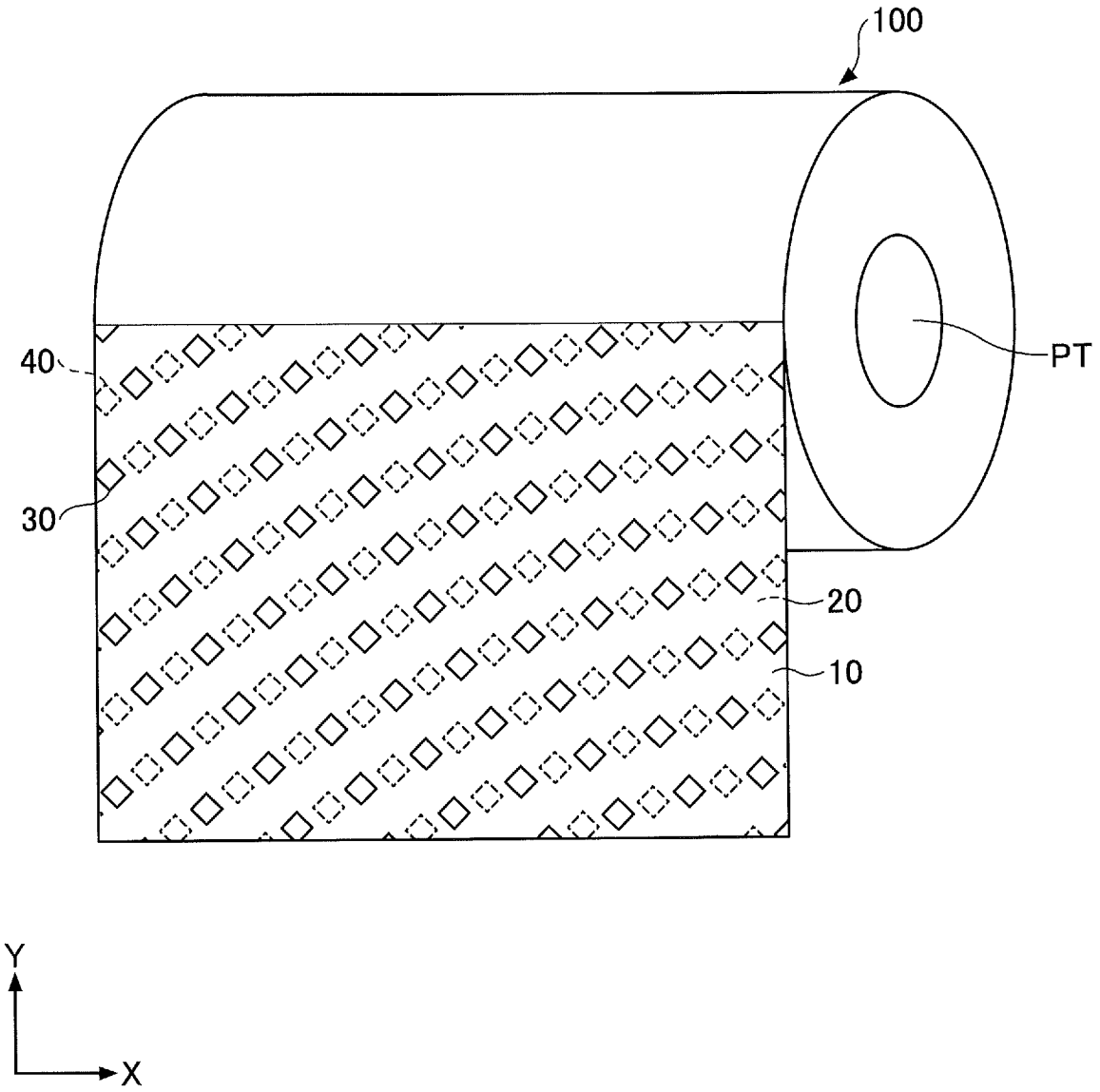
FIG. 1 is a drawing illustrating toilet paper according to an embodiment of the present invention.

According to a first aspect of the present invention, toilet paper that includes a first sheet on which first embossments are formed and a second sheet on which second embossments are formed. The first sheet and the second sheet are joined together in a nested manner, and at least some embossments in one of the first embossments and the second embossments are arranged on a first curve having a sine-wave shape.

According to the first aspect, the first sheet and the second sheet are joined together in a nested manner such that some embossments in the first embossments and/or some embossments in the second embossments are arranged on the first curve having a sine-wave shape. This configuration makes it possible to increase the strength of the toilet paper and make the toilet paper less likely to be flattened in the thickness direction. Also, this configuration enables the toilet paper to retain wiped water. Accordingly, the first aspect makes it possible to provide durable (strong) toilet paper having excellent water absorbency. Also, according to the first aspect, at least some embossments in one of the first embossments and the second embossments are arranged on the first curve having a sine-wave shape. This makes it possible to give an unconventional design to the toilet paper.

In the toilet paper according to a second aspect of the present invention, at least some embossments in one of the first embossments and the second embossments are arranged on a second curve that has a sine-wave shape and is parallel to the first curve. According to the second aspect, some embossments in the first embossments and/or some embossments in the second embossments are also arranged on the second curve that has a sine-wave shape and is parallel to the first curve. This configuration makes it possible to improve the design on the toilet paper while increasing the strength and the water absorbency of the toilet paper.

In the toilet paper according to a third aspect of the present invention, at least some embossments in one of the first embossments and the second embossments are arranged on a third curve that has a sine-wave shape and intersects the first curve. According to the third aspect, some embossments in the first embossments and/or some embossments in the second embossments are also arranged on the third curve that has a sine-wave shape and intersects the first curve. This configuration makes it possible to further improve the design on the toilet paper while further increasing the strength and the water absorbency of the toilet paper.

In the toilet paper according to a fourth aspect of the present invention, at least some embossments in one of the first embossments and the second embossments are arranged on a second curve that has a sine-wave shape and is parallel to the first curve, and at least some embossments in one of the first embossments and the second embossments are arranged on a fourth curve that has a sine-wave shape and is parallel to the third curve.

According to the fourth aspect, some embossments in the first embossments and/or some embossments in the second embossments are arranged on the second curve that has a sine-wave shape and is parallel to the first curve and also on the fourth curve that has a sine-wave shape and is parallel to the third curve. This configuration makes it possible to reliably obtain toilet paper that has improved strength and excellent water absorbency. This configuration can also reliably improve the design on the toilet paper.

In the toilet paper according to a fifth aspect of the present invention, the amplitude of the sine-wave shape is between 10 mm and 60 mm. Setting the amplitude of the sine-wave shape of at least one of the first through fourth curves at a value between 10 mm and 60 mm makes it possible to reliably improve the design on the toilet paper while reliably increasing the strength and the water absorbency of the toilet paper.

In the toilet paper according to a sixth aspect of the present invention, the period of the sine-wave shape is between 50 mm and 300 mm. Setting the period of the sine-wave shape of at least one of the first through fourth curves in this range makes it possible to reliably improve the design on the toilet paper while reliably increasing the strength and the water absorbency of the toilet paper.

In the toilet paper according to a seventh aspect of the present invention, at least one of the area of each of top parts of first embossed protrusions of the first embossments and the area of each of top parts of second embossed protrusions of the second embossments is between 0.8 $mm^2$ and 1.5 $mm^2$. With the configuration of the seventh aspect where the area of each of the top parts of the first embossed protrusions of the first embossments and/or the area of each of the top parts of the second embossed protrusions of the second embossments is set in this range, the sheets are supported by the embossed protrusions. This in turn makes it possible to make the first embossed protrusions and the second embossed protrusions less likely to be flattened, and thereby makes it possible to increase the strength of the toilet paper in the thickness direction.

In the toilet paper according to an eighth aspect of the present invention, at least one of the area percentage of top parts of first embossed protrusions of the first embossments and the area percentage of top parts of second embossed protrusions of the second embossments is between 5% and 10%.

Setting the area percentage of the top parts of the first embossed protrusions of the first embossments and/or the area percentage of the top parts of the second embossed protrusions of the second embossments in this range according to the eighth aspect makes it possible to prevent the embossed protrusions from interfering with each other in a space between the sheets joined in a nested manner. This in turn makes it possible to form a space (which is hereafter referred to as a non-embossment space) where no embossed protrusion is present between the sheets. Accordingly, the eighth aspect makes it possible to provide bulky toilet paper that is less likely to be flattened.

Also, setting the area percentage of the top parts of the first embossed protrusions and/or the area percentage of the top parts of the second embossed protrusions in the above range according to the eighth aspect makes it possible to reduce the bonding area between the embossed protrusions and the sheets. Accordingly, the eighth aspect makes it possible to suppress the toilet paper from becoming hard (inflexible) due to the bonded portions between the sheets.

In the toilet paper according to a ninth aspect, at least one of the area of each of top parts of first embossed protrusions of the first embossments and the area of each of top parts of second embossed protrusions of the second embossments is between 0.8 $mm^2$ and 1.5 $mm^2$, at least one of the area percentage of the top parts of the first embossed protrusions and the area percentage of the top parts of the second embossed protrusions is between 5% and 10%, and at least one of the height of the first embossed protrusions and the height of the second embossed protrusions is between 1.0 mm and 1.7 mm.

In the ninth aspect, the area of each of the top parts of the first embossed protrusions of the first embossments and/or the area of each of the top parts of the second embossed protrusions of the second embossments is set within the above range, at least one of the area percentage of the top parts of the first embossed protrusions and the area percentage of the top parts of the second embossed protrusions is set within the above range, and the height of the first embossed protrusions and/or the height of the second embossed protrusions is set within the above range. This configuration makes it possible to increase the non-embossment space formed between the sheets while maintaining the strength of the toilet paper in the thickness direction. Accordingly, the ninth aspect makes it possible to increase the bulk and the anti-flattening property of the toilet paper.

In the toilet paper according to a tenth aspect of the present invention, a side surface of a first embossed protrusion of each of the first embossments is inclined from the first sheet toward a top part of the first embossed protrusion such that the area of the top part of the first embossed protrusion becomes less than the area of an opening of a first embossed recess corresponding to the first embossed protrusion; and a side surface of a second embossed protrusion of each of the second embossments is inclined from the second sheet toward a top part of the second embossed protrusion such that the area of the top part of the second embossed protrusion becomes less than the area of an opening of a second embossed recess corresponding to the second embossed protrusion.

According to the tenth aspect, the side surface of the embossed protrusion of each of the first embossments and the second embossments is inclined such that the area of the top part of the embossed protrusion becomes less than the area of the opening of the embossed recess. This configuration makes it possible to reliably prevent the embossed protrusions from interfering with each other in a space between the sheets. This makes it possible to further increase the bulk of the toilet paper.

Also, the tenth aspect makes it possible to increase the non-embossment space formed between the sheets and make the toilet paper more unlikely to be flattened. Further, the tenth aspect makes it possible to reduce the bonding area between the embossed protrusions and the sheets and thereby makes it possible to further suppress toilet paper from becoming hard due to bonded portions.

In the toilet paper according to an eleventh aspect of the present invention, a side surface of a first embossed protrusion of each of the first embossments is inclined from the first sheet toward a top part of the first embossed protrusion such that the area of the top part of the first embossed protrusion becomes less than the area of an opening of a first embossed recess corresponding to the first embossed protrusion; a side surface of a second embossed protrusion of each of the second embossments is inclined from the second sheet toward a top part of the second embossed protrusion such that the area of the top part of the second embossed protrusion becomes less than the area of an opening of a second embossed recess corresponding to the second embossed protrusion; and the inclination angle of each of the side surface of the first embossed protrusion and the side surface of the second embossed protrusion is between 60 degrees and 80 degrees.

According to the eleventh aspect, the side surface of the embossed protrusion of each of the first embossments and the second embossments is inclined such that the area of the top part of the embossed protrusion becomes less than the area of the opening of the embossed recess, and the inclination angle of each of the side surface of the first embossed protrusion and the side surface of the second embossed protrusion is set within the above range. This configuration makes it possible to further suppress the toilet paper from becoming hard due to bonded portions while maintaining the bulk and the anti-flattening property of the toilet paper.

According to a twelfth aspect of the present invention, the compression strength of the toilet paper under a load of 500 $gf/cm^2$ is greater than or equal to 5.0 $gf \cdot cm/cm^2$. In the twelfth aspect, the compression strength of the toilet paper under a load of 500 $gf/cm^2$ is in the above range. This configuration makes it possible to reliably increase the strength and durability of the toilet paper. When the compression strength of toilet paper under the load of 500 $gf/cm^2$ is in the above range, the toilet paper is readily compressed and therefore the toilet paper becomes soft.

According to a thirteenth aspect of the present invention, the compression ratio of the toilet paper under a load of 50 $gf/cm^2$ is less than or equal to 70%. In the thirteenth aspect, the compression ratio of the toilet paper under a load of 50 $gf/cm^2$ is less than or equal to 70%. This configuration makes it possible to reliably obtain bulky toilet paper that is less likely to be flattened.

Embodiments of the present invention are described below with reference to the accompanying drawings. In the descriptions below, for ease of understanding, the same reference number is assigned to the same component or corresponding components throughout the drawings and repeated descriptions of those components may be omitted unless otherwise mentioned. Also, in the present application, the scale of components in the drawings may be different from the actual scale.

Figure 2:
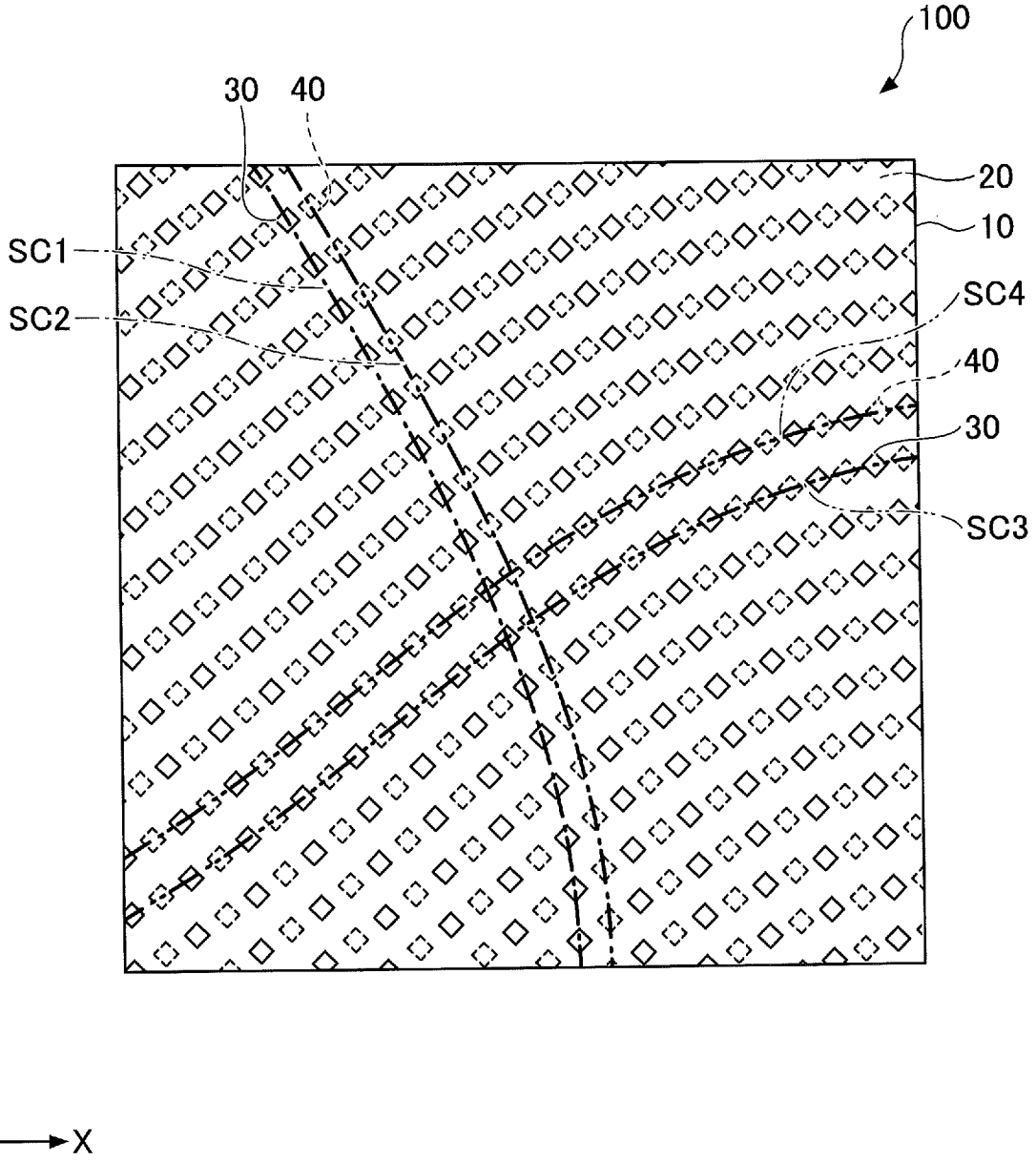
FIG. 2 is a drawing illustrating sheets of crepe paper constituting toilet paper according to an embodiment (first embodiment)
Figure 3:
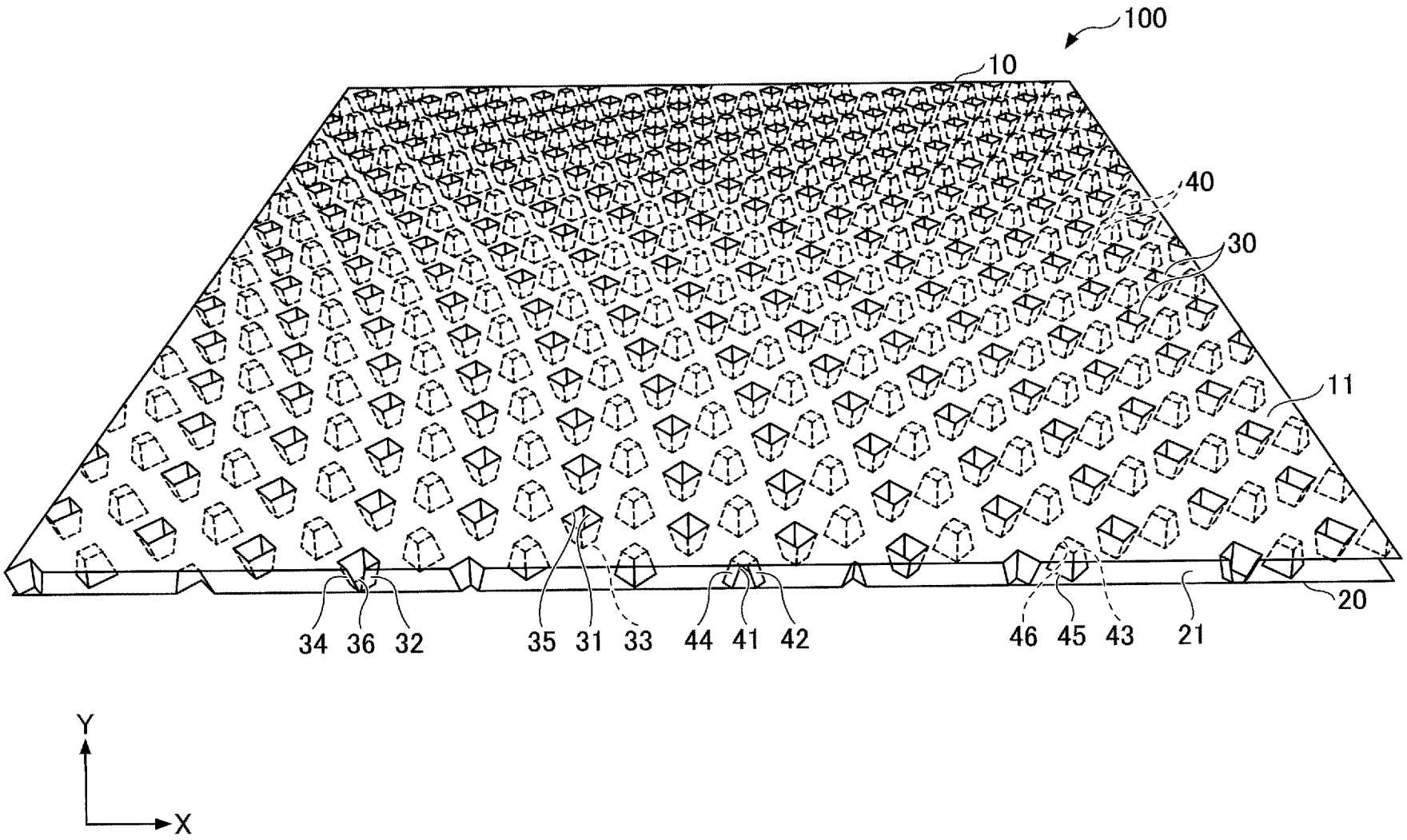
FIG. 3 is a perspective view of FIG. 2 viewed in a Y direction.
Figure 4:
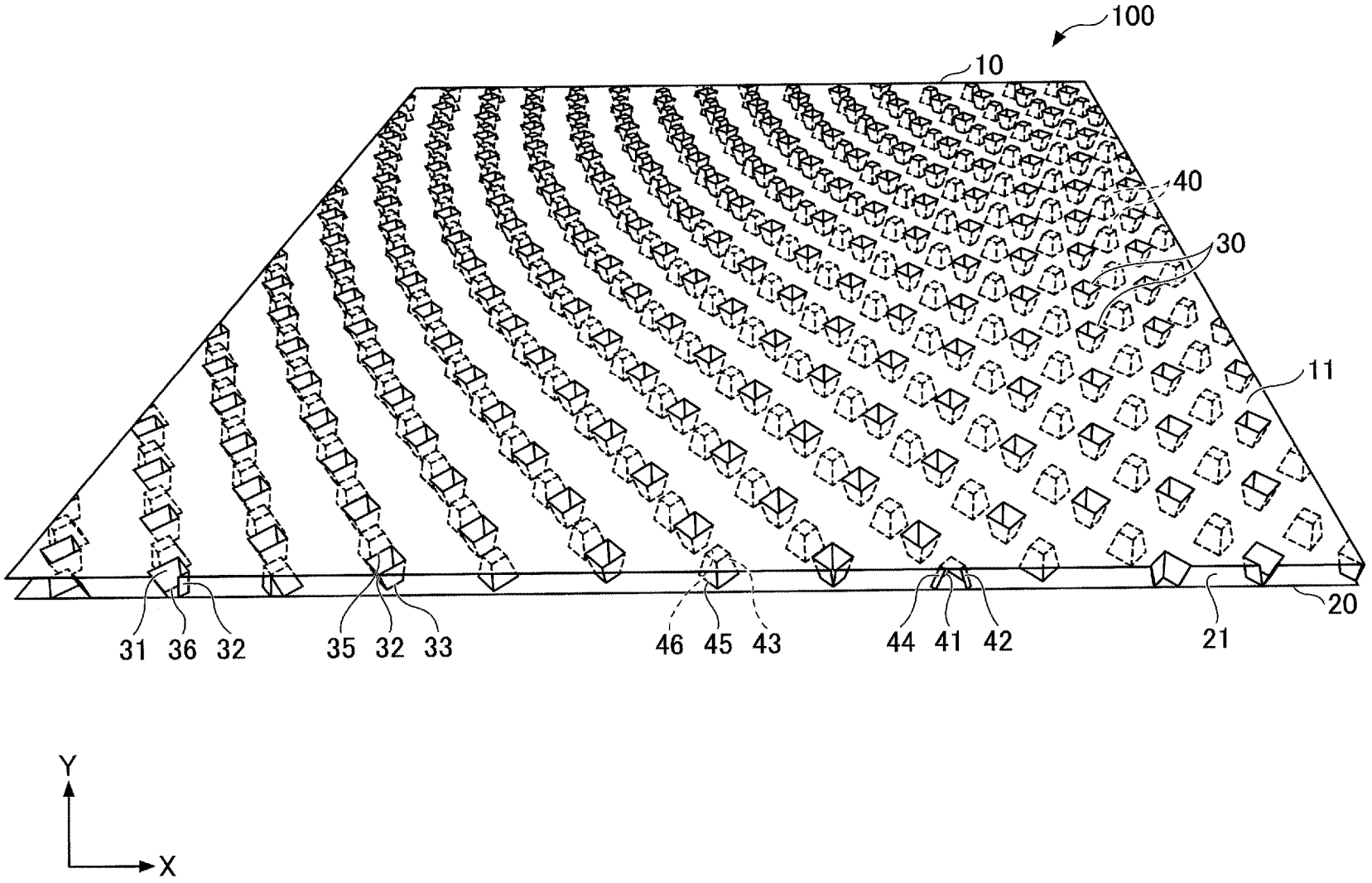
FIG. 4 is a perspective view of FIG. 2 viewed in the Y direction.

FIG. 1 illustrates toilet paper according to an embodiment of the present invention, and FIG. 2 illustrates sheets of crepe paper constituting toilet paper according to an embodiment (first embodiment). FIG. 3 is a perspective view of toilet paper 100 viewed in a Y direction, and FIG. 4 is a perspective view of the toilet paper 100 viewed in an X direction.

The toilet paper 100 illustrated in FIG. 1 is an example of toilet paper according to the present invention. The toilet paper 100 is rolled toilet paper formed by winding, around a paper tube PT, a strip of toilet paper in which perforation lines (not shown) for separation are formed at appropriate intervals. The form of toilet paper is not limited to rolled toilet paper used in the present embodiment. For example, the present invention may also be applied to stacked (pick-up or pop-up) toilet paper where toilet paper sheets are folded and stacked.

The toilet paper 100 includes crepe paper 10 and crepe paper 20. Fine wrinkles are formed on the surface of each of the crepe paper 10 and the crepe paper 20 by bringing a so-called doctor blade into contact with the surface at the exit of a dryer of a paper machine in a paper sheet making process. The crepe paper 10 is an example of a first sheet constituting the toilet paper of the present invention, and the crepe paper 20 is an example of a second sheet constituting the toilet paper of the present invention.

The crepe paper 10 and the crepe paper 20 are made of base paper that is made mostly from pulp. The composition of pulp of the base paper may be a normal composition of pulp used for toilet paper. For example, the proportion of pulp is 90 wt %, is preferably greater than or equal to 95 wt %, and is more preferably 100 wt %.

The pulp composition of the crepe paper 10 and the crepe paper 20 is not limited to any specific composition. For example, softwood pulp such as needle bleached kraft pulp (NBKP) or needle unbleached kraft pulp (NUKP) and hardwood pulp such as leaf bleached kraft pulp (LBKP) or leaf unbleached kraft pulp (LUKP) may be mixed at an appropriate ratio. For example, the ratio of softwood pulp to hardwood pulp may be between 30:70 and 80:20.

Also, paper having a predetermined basis weight (or paper weight in gsm) conforming to JIS P 8124 (1998) is used for the crepe paper 10 and the crepe paper 20. As a non-limiting example, the predetermined basis weight may be in a range between 10 $g/m^2$ and 25 $g/m^2$, and is preferably in a range between 12 $g/m^2$ and 20 $g/m^2$ in view of, for example, flexibility, hydrolysis, and wiping performance of toilet paper.

As illustrated in FIGS. 2 through 4, the crepe paper 10 includes embossments 30 and a non-embossed part 11. The non-embossed part 11 is a portion of the crepe paper 10 that is surrounded by the embossments 30 and where the embossments 30 are not formed.

Each embossment 30 is comprised of an embossed recess 31 and an embossed protrusion 32 corresponding to the embossed recess 31. Multiple embossed recesses 31 and multiple embossed protrusions 32 are formed on the front side and the back side of the crepe paper 10 (see FIGS. 2-4). The embossments 30, the embossed recesses 31, and the embossed protrusions 32 are examples of first embossments, first embossed recesses, and first embossed protrusions formed on a first sheet constituting toilet paper of the present invention.

Each of an opening 35 of the embossed recess 31, a bottom 36 of the embossed recess 31, and a top part 33 of the embossed protrusion 32 has a quadrangular shape in plan view (see FIGS. 2-4). Also, the quadrangular shape of the opening 35 of the embossed recess 31 and the quadrangular shape of the top part 33 of the embossed protrusion 32 are similar to each other. The top part 33 of the embossed protrusion 32 corresponds to the bottom 36 of the embossed recess 31. Thus, the embossed protrusion 32 has the shape of a truncated quadrangular pyramid. However, the shape of the embossed protrusion 32 is not limited to the truncated quadrangular pyramid. For example, the embossed protrusion 32 may be shaped like a truncated triangular pyramid or a truncated cone.

According to an embossing method such as a steel rubber method, the embossed recesses 31 are formed on one side of the crepe paper 10 as recesses by pressing a protrusion embossing roller (not shown) against the crepe paper 10 placed between the protrusion embossing roller and a rubber roller. On the other hand, the embossed protrusions 32 are formed on the other side of the crepe paper 10 as protrusions corresponding to the embossed recesses 31.

The crepe paper 20 includes embossments 40 and a non-embossed part 21. The non-embossed part 21 is a portion of the crepe paper 20 that is surrounded by the embossments 40 and where the embossments 40 are not formed.

As illustrated in FIGS. 2 through 4, each embossment 40 is comprised of an embossed recess 41 and an embossed protrusion 42 corresponding to the embossed recess 41. Multiple embossed recesses 41 and multiple embossed protrusions 42 are formed on the front side and the back side of the crepe paper 20. The embossments 40, the embossed recesses 41, and the embossed protrusions are examples of second embossments, second embossed recesses, and second embossed protrusions formed on a second sheet constituting toilet paper of the present invention.

Each of an opening 45 of the embossed recess 41, a bottom 46 of the embossed recess 41, and a top part 43 of the embossed protrusion 42 has a quadrangular shape in plan view. Also, the quadrangular shape of the opening 45 of the embossed recess 41 and the quadrangular shape of the top part 43 of the embossed protrusion 42 are similar to each other. The top part 43 of the embossed protrusion 42 corresponds to the bottom of the embossed recess 41. Thus, the embossed protrusion 42 has the shape of a truncated quadrangular pyramid. However, the shape of the embossed protrusion 42 is not limited to the truncated quadrangular pyramid. For example, the embossed protrusion 42 may be shaped like a truncated triangular pyramid or a truncated cone.

According to an embossing method such as a steel rubber method, the embossed recesses 41 are formed on one side of the crepe paper 20 as recesses by pressing a protrusion embossing roller (not shown) against the crepe paper 20 placed between the protrusion embossing roller and a rubber roller. On the other hand, the embossed protrusions 42 are formed on the other side of the crepe paper 20 as protrusions corresponding to the embossed recesses 41.

In the embodiment illustrated in FIGS. 2 through 4, the embossed protrusions 32 of the embossments 30 of the crepe paper 10 and the embossed protrusions 42 of the embossments 40 of the crepe paper have the same shape. However, the embossed protrusions 32 of the embossments 30 of the crepe paper 10 may have a shape that is different from the shape of the embossed protrusions 42 of the embossments 40 of the crepe paper 20.

In the toilet paper 100 of the present embodiment, the crepe paper 10 having the embossments 30 and the crepe paper 20 having the embossments 40 are joined together such that a surface of the crepe paper 10 having the embossed protrusions 32 and a surface of the crepe paper 20 having the embossed protrusions 42 are disposed to face each other in a nested manner. Specifically, as illustrated in FIGS. 2 through 4, the embossed protrusions 32 of the crepe paper 10 are disposed to face the non-embossed part 21 (a portion where no embossed protrusion 42 is formed) of the crepe paper 20. On the other hand, the embossed protrusions 42 of the crepe paper 20 are disposed to face the non-embossed part 11 (a portion where no embossed protrusion 32 is formed) of the crepe paper 10.

The top parts 43 of the embossed protrusions 42 of the crepe paper 20 are bonded to the non-embossed part 11 of the crepe paper 10 with an adhesive (not shown). Bonding the top parts 43 of the embossed protrusions 42 of the crepe paper 20 to the non-embossed part 11 of the crepe paper 10 makes it possible to arrange bonded portions between the crepe paper 10 and the crepe paper 20 on one (the crepe paper 10) of two sheets of crepe paper in a balanced manner. This configuration makes it possible to decrease the bonded portions between the crepe paper 10 and the crepe paper 20 that tend to become hard and to disperse the bonded portions between the crepe paper 10 and the crepe paper 20.

As the adhesive, any known adhesive used for toilet paper having a laminated structure may be used. Examples of major components of such an adhesive include polyvinyl alcohol, starch, modified starch, and carboxymethylcellulose.

In the present embodiment, the top parts 33 of the embossed protrusions 32 of the crepe paper 10 are not bonded to the non-embossed part 21 of the crepe paper 20. However, instead of bonding the top parts 43 of the embossed protrusions 42 of the crepe paper 20 to the non-embossed part 11 of the crepe paper 10, the top parts 33 of the embossed protrusions 32 of the crepe paper 10 may be bonded to the non-embossed part 21 of the crepe paper 20. Also, in addition to bonding the top parts 43 of the embossed protrusions 42 of the crepe paper 20 to the non-embossed part 11 of the crepe paper 10, the top parts 33 of the embossed protrusions 32 of the crepe paper 10 may be bonded to the non-embossed part 21 of the crepe paper 20.

As illustrated in FIGS. 1 through 4, in the toilet paper 100, at least some embossments in one of the embossments 30 and the embossments 40 are arranged on a sine-wave curve SC1. In the present application, a sine-wave curve indicates a sine curve or a sinusoid having a constant period (wavelength) and a constant amplitude. Also, the sine-wave curve is a virtual curve shown on the toilet paper. The curve SC1 extends in the Y direction (the direction in which the rolled toilet paper 100 is pulled out) in FIGS. 1 through 4. The curve SC1 is an example of a first curve in toilet paper of the present invention.

In the toilet paper 100 illustrated in FIGS. 2 through 4, some embossments in the embossments 30 of the crepe paper 10 are arranged on the curve SC1. That is, some embossments in the embossments 30 are arranged along the curve SC1 to form a sine wave shape. Here, the configuration of the toilet paper 100 is not limited to the configuration where only some embossments in the embossments 30 are arranged on the curve SC1. That is, the toilet paper 100 may be configured such that only some embossments in the embossments 40 are arranged on the curve SC1, or may be configured such that both of some embossments in the embossments 30 and some embossments in the embossments 40 are arranged on the curve SC1.

Also, in the toilet paper 100 illustrated in FIGS. 2 through 4, all of the embossments 30 are arranged on the sine-wave curve SC1. However, the configuration of the toilet paper 100 is not limited to this configuration. Thus, in the present embodiment, as long as at least some embossments in one of the embossments 30 and the embossments 40 are arranged on the sine-wave curve SC1, some embossments in another one of the embossments 30 and the embossments 40 may be arranged on a straight or apparently straight line different from a sine-wave curve.

In the toilet paper 100 illustrated in FIGS. 2 through 4, the crepe paper 10 and the crepe paper 20 are joined in a nested manner such that some embossments in the embossments 30 are arranged on the sine-wave curve SC1. This configuration makes it possible to increase the strength of the toilet paper 100 and to make the toilet paper 100 less likely to be flattened in the thickness direction. Also, this configuration enables the toilet paper 100 to more reliably retain wiped water. Thus, the toilet paper 100 illustrated in FIGS. 2 through 4 has improved strength and water absorbency.

Also, when the toilet paper 100 is implemented as rolled paper and is pulled out from a holder (not shown), the embossments 30 arranged in a sine-wave shape look like a wave pattern. Accordingly, the configuration of the toilet paper 100 illustrated in FIGS. 2 through 4 can cause a user to feel stereoscopic and visual softness and can provide an unconventional design.

Further, when the crepe paper 10 and the crepe paper 20 are joined in a nested manner such that some embossments in the embossments 30 are arranged on the sine-wave curve SC1, the portion of the protrusion embossing roller and the portion of the rubber roller corresponding to the embossments 30 arranged in the sine-curve shape are not linearly aligned. This in turn makes it possible to prevent the surface of the protrusion embossing roller from contacting the same position on the surface of the rubber roller. Accordingly, this configuration makes it possible to reduce the wear of the protrusion embossing roller and the rubber roller.

In the toilet paper 100 illustrated in FIGS. 2 through 4, at least some embossments in one of the embossments 30 and the embossments 40 are arranged on a sine-wave curve SC2. The curve SC2 is parallel to the sine-wave curve SC1. That is, the curve SC2 is disposed at a predetermined distance from the curve SC1. Similarly to the curve SC1, the curve SC2 extends in the Y direction in FIGS. 2 through 4. The curve SC2 is an example of a second curve in toilet paper of the present invention.

In the toilet paper 100 illustrated in FIGS. 2 through 4, some embossments in the embossments 40 of the crepe paper 20 are arranged on the curve SC2. Thus, some embossments in the embossments 40 are arranged in a sine-wave shape along the curve SC2 that is parallel to the curve SC1 while some embossments in the embossments 30 are arranged in a sine-wave shape along the curve SC1.

The configuration of the toilet paper 100 is not limited to the configuration where only some embossments in the embossments 40 are arranged on the curve SC2. That is, the toilet paper 100 may be configured such that only some embossments in the embossments 30 are arranged on the curve SC2, or may be configured such that both of some embossments in the embossments 30 and some embossments in the embossments 40 are arranged on the curve SC2.

Thus, in the toilet paper 100 illustrated in FIGS. 2 through 4, some embossments in the embossments 30 are arranged in a sine-wave shape along the curve SC1 and some embossments in the embossments 40 are arranged in a sine-wave shape along the curve SC2 parallel to the curve SC1. This configuration makes it possible to improve the design on the toilet paper 100 while improving the strength and the water absorbency of the toilet paper 100.

In the toilet paper 100 illustrated in FIGS. 2 through 4, at least some embossments in one of the embossments 30 and the embossments 40 are arranged on a sine-wave curve SC3. The curve SC3 intersects the sine-wave curve SC1. The curve SC1 and the curve SC3 may intersect each other in any manner. In the toilet paper 100 illustrated in FIGS. 2 through 4, the curve SC1 and the curve SC3 intersect each other at one point. The curve SC3 extends in the X direction in FIGS. 2 through 4. The curve SC3 is an example of a third curve in toilet paper of the present invention.

In the toilet paper 100 illustrated in FIGS. 2 through 4, some embossments in the embossments 30 and some embossments in the embossments 40 are arranged alternately on the curve SC3. With this configuration, while some embossments in the embossments 30 are arranged in a sine-wave shape along the curve SC1, some other embossments in the embossments 30 and some embossments in the embossments 40 are arranged alternately in a sine-wave shape along the curve SC3 intersecting the curve SC1. Here, at a point where the curve SC1 intersects the curve SC3, an embossment in the embossments 30 and/or an embossment in the embossments 40 may be disposed as a common embossment(s).

The configuration of the toilet paper 100 is not limited to the configuration where both of some embossments in the embossments 30 and some embossments in the embossments 40 are arranged on the curve SC3. That is, the toilet paper 100 may be configured such that only some embossments in the embossments 30 are arranged on the curve SC3 or may be configured such that only some embossments in the embossments 40 are arranged on the curve SC3.

With the above-described configuration, some embossments in the embossments 30 are arranged in a sine-wave shape along the curve SC1, and some other embossments in the embossments 30 and some embossments in the embossments 40 are arranged alternately in a sine-wave shape along the curve SC3 intersecting the curve SC1. This configuration makes it possible to further improve the design of the toilet paper while further improving the strength and the water absorbency of the toilet paper.

In the toilet paper 100 illustrated in FIGS. 2 through 4, at least some embossments in one of the embossments 30 and the embossments 40 are arranged on the sine-wave curve SC2 that is parallel to the curve SC1, and at least some other embossments in one of the embossments 30 and the embossments 40 are arranged on a sine-wave curve SC4 that is parallel to the curve SC3.

The sine-wave curve SC4 is parallel to the curve SC3 and intersects both of the curve SC1 and the curve SC2. Similarly to the curve SC3, the curve SC4 extends in the X direction in FIGS. 2 through 4. The curve SC4 is an example of a fourth curve in toilet paper of the present invention.

In the toilet paper 100 illustrated in FIGS. 2 through 4, some embossments in the embossments 30 and some embossments in the embossments 40 are arranged alternately on the curve SC4. With this configuration, while some embossments in the embossments 30 and some embossments in the embossments 40 are arranged alternately in a sine-wave shape along the curve SC3 that intersects both of the curve SC1 and the curve SC2, some other embossments in the embossments 30 and some other embossments in the embossments 40 are arranged alternately in a sine-wave shape along the curve SC4 that is parallel to the curve SC3.

The configuration of the toilet paper 100 is not limited to the configuration where both of some embossments in the embossments 30 and some embossments in the embossments 40 are arranged on the curve SC4. That is, the toilet paper 100 may be configured such that only some embossments in the embossments 30 are arranged on the curve SC4 or may be configured such that only some embossments in the embossments 40 are arranged on the curve SC4.

Thus, in the toilet paper 100 illustrated in FIGS. 2 through 4, some embossments in the embossments 30 are arranged in a sine-wave shape along the curve SC1, some embossments in the embossments 40 are arranged in a sine-wave shape along the curve SC2 parallel to the curve SC1, and some embossments in the embossments 30 and some embossments in the embossments 40 are arranged alternately in sine-wave shapes along the curve SC3 intersecting the curve SC1 and the curve SC2 and the curve SC4 that is parallel to the curve SC3. This configuration makes it possible to reliably improve the design of the toilet paper 100 while reliably improving the strength and the water absorbency of the toilet paper 100.

Figure 5:
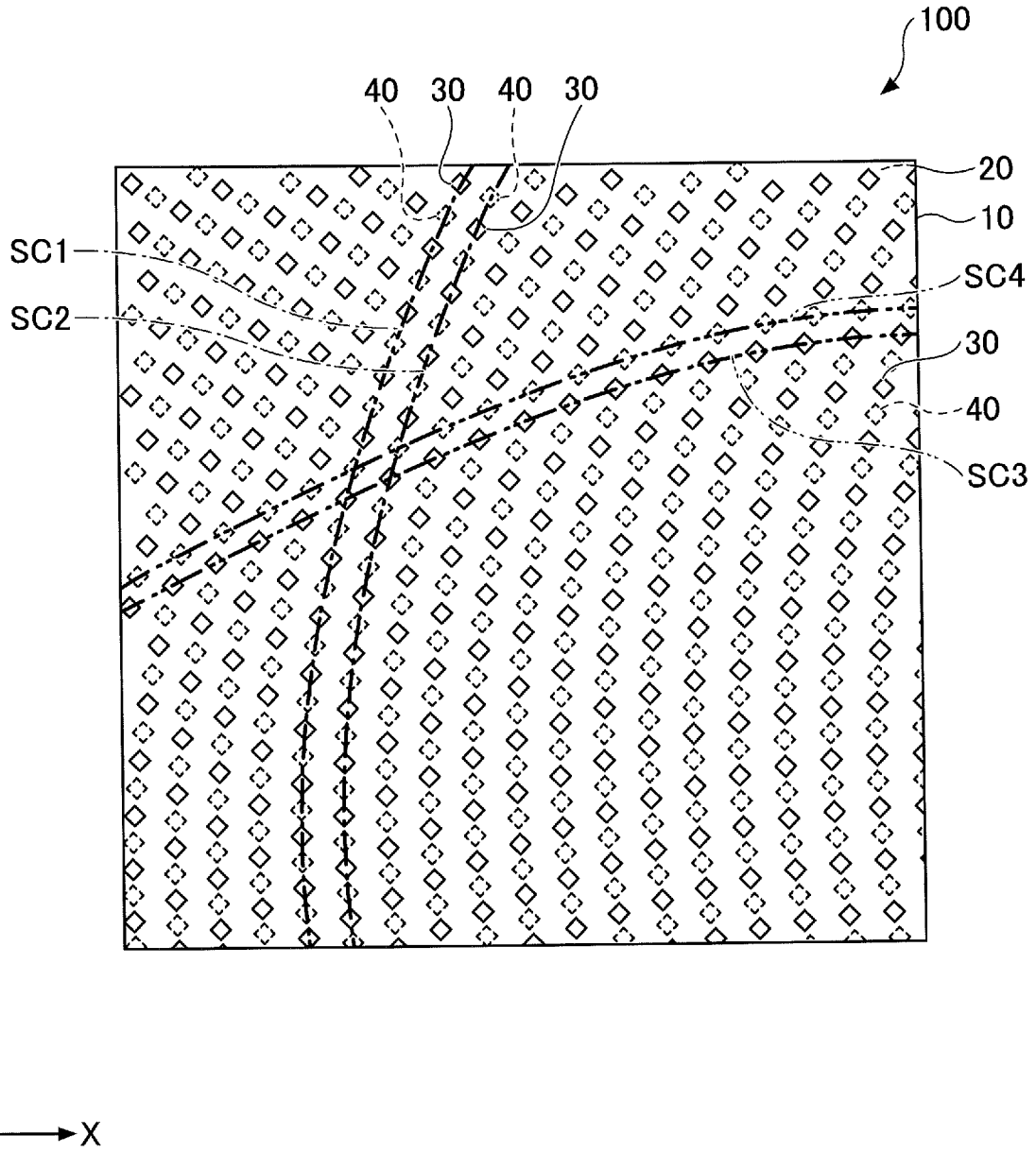
FIG. 5 is a drawing illustrating sheets of crepe paper constituting toilet paper according to an embodiment (second embodiment)

FIG. 5 is a drawing illustrating sheets of crepe paper constituting toilet paper according to an embodiment (second embodiment). In toilet paper 100 illustrated in FIG. 5, both of some embossments in the embossments 30 of the crepe paper 10 and some embossments in the embossments 40 of the crepe paper 20 are arranged on a curve SC1. That is, some embossments in the embossments 30 and some embossments in the embossments 40 are arranged alternately in a sine-wave shape along the curve SC1.

With the configuration illustrated in FIG. 5 where some embossments in the embossments 30 of the crepe paper 10 and some embossments in the embossments 40 of the crepe paper 20 are arranged alternately on the curve SC1, the strength of the toilet paper 100 can be increased, and the toilet paper 100 becomes less likely to be flattened in the thickness direction. Also, this configuration enables the toilet paper 100 to more reliably retain wiped water. Thus, the toilet paper 100 illustrated in FIG. 5 has improved durability (strength) and water absorbency and is less likely to be flattened.

Also, when the toilet paper 100 illustrated in FIG. 5 is implemented as rolled paper and is pulled out from a holder (not shown), the embossments 30 and the embossments 40 arranged alternately in a sine-wave shape look like a wave pattern. Accordingly, the configuration of the toilet paper 100 illustrated in FIG. 5 can cause a user to feel stereoscopic and visual softness and can provide an unconventional design.

In the toilet paper 100 illustrated in FIG. 5, some embossments in the embossments 30 of the crepe paper 10 and some embossments in the embossments 40 of the crepe paper 20 are arranged on a curve SC2 that is parallel to the curve SC1. With this configuration, while some embossments in the embossments 30 and some embossments in the embossments 40 are arranged alternately in a sine-wave shape along the curve SC1, some other embossments in the embossments 30 and some other embossments in the embossments 40 are arranged alternately in a sine-wave shape along the curve SC2 that is parallel to the curve SC1.

Thus, in the toilet paper 100 illustrated in FIG. 5, some embossments in the embossments 30 and some embossments in the embossments 40 are arranged alternately in a sine-wave shape along the curve SC1, and some other embossments in the embossments 30 and some other embossments in the embossments 40 are arranged alternately in a sine-wave shape along the curve SC2 that is parallel to the curve SC1. This configuration makes it possible to improve the design of the toilet paper 100 while improving the strength and the water absorbency of the toilet paper 100.

Also, in the toilet paper 100 illustrated in FIG. 5, some embossments in the embossments 30 are arranged on a curve SC3. With this configuration, while some embossments in the embossments 30 and some embossments in the embossments 40 are arranged alternately in a sine-wave shape along the curve SC1, some other embossments in the embossments 30 are arranged in a sine-wave shape along the curve SC3 that intersects the curve SC1.

Thus, in the above configuration, some embossments in the embossments 30 and some embossments in the embossments 40 are arranged alternately in a sine-wave shape along the curve SC1, and some other embossments in the embossments 30 are arranged in a sine-wave shape along the curve SC3 that intersects the curve SC1. This configuration makes it possible to further improve the design of the toilet paper while further improving the strength and the water absorbency of the toilet paper.

Also, in the toilet paper 100 illustrated in FIG. 5, some embossments in the embossments 40 are arranged on a curve SC4. Accordingly, some embossments in the embossments 30 are arranged in a sine-wave shape along the curve SC3 that intersects both of the curve SC1 and the curve SC2, and some embossments in the embossments 40 are arranged in a sine-wave shape along the curve SC4 that is parallel to the curve SC3.

Thus, in the toilet paper 100 illustrated in FIG. 5, some embossments in the embossments 30 and some embossments in the embossments 40 are arranged alternately in a sine-wave shape along the curve SC1, some other embossments in the embossments 30 and some other embossments in the embossments 40 are arranged alternately in a sine-wave shape along the curve SC2 parallel to the curve SC1, some other embossments in the embossments 30 are arranged in a sine-wave shape along the curve SC3 intersecting the curve SC1 and the curve SC2, and some other embossments in the embossments 40 are arranged in a sine-wave shape along the curve SC4 parallel to the curve SC3. This configuration makes it possible to reliably improve the design of the toilet paper 100 while reliably improving the strength and the water absorbency of the toilet paper 100.

In the toilet paper of the present embodiment, the sine-wave shapes of the curves SC1 through SC4 may have any amplitude. However, for example, the amplitude of the sine-wave shape of at least one of the curves SC1 through SC4 is preferably between 10 mm and 60 mm, more preferably between 20 mm and 50 mm, and further preferably between 35 mm and 45 mm. In the toilet paper 100 illustrated in FIGS. 2 and 5, the amplitude of the sine-wave shape of each of the curves SC1 through SC4 is within the range between 10 mm and 60 mm. Setting the amplitude of the sine-wave shape of at least one of the curves SC1 through SC4 in this range makes it possible to reliably improve the design on the toilet paper 100 while reliably increasing the strength and the water absorbency of the toilet paper 100.

In the toilet paper of the present embodiment, the sine-wave shapes of the curves SC1 through SC4 may have any period (wavelength). However, for example, the period of the sine-wave shape of at least one of the curves SC1 through SC4 is preferably between 50 mm and 300 mm, more preferably between 100 mm and 280 mm, and further preferably between 150 mm and 250 mm. In the toilet paper 100 illustrated in FIGS. 2 and 5, the period of the sine-wave shape of each of the curves SC1 through SC4 is within the range between 50 mm and 300 mm. Setting the period of the sine-wave shape of at least one of the curves SC1 through SC4 in this range makes it possible to reliably improve the design on the toilet paper 100 while reliably increasing the strength and the water absorbency of the toilet paper 100.

In the toilet paper 100 illustrated in FIGS. 2 through 5, the area of each of the top parts 33 of the embossed protrusions 32 facing the crepe paper 20 and the top parts 43 of the embossed protrusions 42 facing the crepe paper 10 is preferably between 0.8 $mm^2$ and 1.5 $mm^2$, more preferably between 0.9 $mm^2$ and 1.4 $mm^2$, and further preferably between 1.0 $mm^2$ and 1.3 $mm^2$.

The area of the top part 33 of the embossed protrusion 32 indicates the area of the top part 33 of each embossed protrusion 32. Also, the area of the top part 43 of the embossed protrusion 42 indicates the area of the top part 43 of each embossed protrusion 42. Hereafter, the area of the top part of each embossed protrusion may be referred to as an individual area.

When the individual area of each of the embossed protrusions 32 and the embossed protrusions 42 is set within one of the above ranges, the crepe paper 10 is supported by the embossed protrusions 42 and the crepe paper 20 is supported by the embossed protrusions 32. This in turn makes it possible to make the embossed protrusions 32 and the embossed protrusions 42 less likely to be flattened, and thereby makes it possible to increase the strength of the toilet paper 100 in the thickness direction.

In the toilet paper 100 illustrated in FIGS. 2 through 5, each of the area percentage of the top parts 33 of the embossed protrusions 32 facing the crepe paper 20 and the area percentage of the top parts 43 of the embossed protrusions 42 facing the crepe paper 10 is preferably between 5% and 10%, more preferably between 7% and 10%, and further preferably between 8% and 10%.

The area percentage of the top parts 33 of the embossed protrusions 32 indicates the percentage of the area of the top parts 33 of the embossed protrusions 32 in the crepe paper 10. Also, the area percentage of the top parts 43 of the embossed protrusions 42 indicates the percentage of the area of the top parts 43 of the embossed protrusions 42 in the crepe paper 20. In the present application, the area percentage of the top parts of the embossed protrusions may be referred to as a gluing area percentage.

Setting the area percentage of the embossed protrusions 32 and the area percentage of the embossed protrusions 42 within the above ranges makes it possible to prevent the embossed protrusions 32 and the embossed protrusions 42 from interfering with each other in a space between the crepe paper 10 and the crepe paper 20 that are joined in a nested manner, and makes it possible to form a non-embossment space between the crepe paper 10 and the crepe paper 20. Accordingly, the toilet paper 100 becomes bulky and less likely to be flattened.

Further, setting the area percentage of the embossed protrusions 32 and the area percentage of the embossed protrusions 42 within the above ranges makes it possible to reduce the bonding area between the embossed protrusions 32 and the crepe paper 20 and between the embossed protrusions 42 and the crepe paper 10. This in turn makes it possible to suppress the toilet paper 100 from becoming hard due to the bonded portions of the crepe paper 10 and the crepe paper 20.

Also, in the present embodiment, the height of the embossed protrusions 32 and 42 is preferably between 1.0 mm and 1.7 mm, more preferably between 1.1 mm and 1.5 mm, and further preferably between 1.2 mm and 1.4 mm. The height of the embossed protrusion 32 is the distance from the surface of the crepe paper 10 on which the embossed protrusion 32 is formed to the top part 33 of the embossed protrusion 32, and the height of the embossed protrusion 42 is the distance from the surface of the crepe paper 20 on which the embossed protrusion is formed to the top part 43 of the embossed protrusion 42.

In the present embodiment, the height of the embossed protrusions 32 and 42 is set within the above ranges so that the non-embossment space formed between the crepe paper 10 and the crepe paper 20 can be increased while maintaining the strength in the thickness direction of the toilet paper 100. Accordingly, the toilet paper 100 becomes bulkier and more unlikely to be flattened.

In present embodiment, as illustrated in FIGS. 3 and 4, a side surface 34 of the embossed protrusion 32 of the crepe paper 10 is inclined such that the area of the top part 33 of the embossed protrusion 32 becomes less than the area of the opening 35 of the embossed recess 31. That is, the embossed protrusion 32 tapers from the surface of the crepe paper 10 on which the embossed protrusion 32 is formed toward the top part 33 (or the bottom 36) of the embossed protrusion 32.

Also, a side surface 44 of the embossed protrusion 42 of the crepe paper 20 is inclined such that the area of the top part 43 of the embossed protrusion 42 becomes less than the area of the opening 45 of the embossed recess 41. That is, the embossed protrusion 42 tapers from the surface of the crepe paper 20 on which the embossed protrusion 42 is formed toward the top part 43 (or the bottom 46) of the embossed protrusion 42.

With the configuration where the side surfaces 34 of the embossed protrusions 32 of the crepe paper 10 and the side surfaces 44 of the embossed protrusions 42 of the crepe paper 20 are inclined, it is possible to prevent the embossed protrusions 32 and the embossed protrusions 42 from interfering with each other in a space between the crepe paper 10 and the crepe paper 20. This in turn makes the toilet paper 100 bulkier and more unlikely to be flattened.

Also, because the embossed protrusion 32 tapers from the surface of the crepe paper 10 on which the embossed protrusion 32 is formed toward the top part 33 (or the bottom 36) of the embossed protrusion 32, the bonding area between the embossed protrusions 32 and the crepe paper 20 can be reduced. This in turn makes it possible to suppress the toilet paper 100 from becoming hard due to the bonded portions between the crepe paper 10 and the crepe paper 20.

Also, the embossed protrusion 42 tapers from the surface of the crepe paper 20 on which the embossed protrusion 42 is formed toward the top part 43 (or the bottom 46) of the embossed protrusion 42. With this configuration, even when the top parts 43 of the embossed protrusions 42 of the crepe paper 20 are bonded to the non-embossed part 11 of the crepe paper 10, the bonding area between the embossed protrusions 42 and the crepe paper 10 can be reduced. This in turn makes it possible to suppress the toilet paper 100 from becoming hard due to the bonded portions between the crepe paper 10 and the crepe paper 20.

Each of the inclination angle of the side surface 34 of the embossed protrusion 32 and the inclination angle of the side surface 44 of the embossed protrusion 42 is preferably between 60 degrees and 80 degrees, more preferably between 63 degrees and 77 degrees, and further preferably between 65 degrees and 75 degrees.

Here, the inclination angle of the side surface 34 of the embossed protrusion 32 is the angle between the surface of the crepe paper 10 on which the embossed protrusion 32 is formed and the side surface 34 of the embossed protrusion 32. Also, the inclination angle of the side surface 44 of the embossed protrusion 42 is the angle between the surface of the crepe paper 20 on which the embossed protrusion 42 is formed and the side surface 44 of the embossed protrusion 42.

Setting the inclination angle of the side surfaces 34 and 44 of the embossed protrusions 32 and 42 at a value between 60 degrees and 80 degrees makes it possible to further suppress the toilet paper from becoming hard due to bonded portions while maintaining the bulk and the anti-flattening property of the toilet paper.

The compression strength of the toilet paper 100 under a load of 500 gf/cm$^2$ is preferably greater than or equal to 5.0 gf·cm/cm$^2$. Here, the compression strength under the load of 500 gf/cm$^2$ corresponds to compression energy (gf·cm/cm$^2$) generated when the load of 500 gf/cm$^2$ is applied to the toilet paper 100 in the thickness direction. The load of 500 gf/cm$^2$ is set as an excessive pressure exceeding a pressure that is supposed to be applied when toilet paper is used.

Setting the physical characteristics of the toilet paper 100 as described above makes it possible to further increase the strength of the toilet paper 100. This in turn makes it possible to provide durable (strong) toilet paper 100 while maintaining the bulk and the anti-flattening property of the toilet paper 100. When the compression strength of toilet paper under a load of 500 gf/cm$^2$ is greater than or equal to 5.0 gf·cm/cm$^2$, the toilet paper is readily compressed. Therefore, the toilet paper becomes soft.

Also, the compression ratio of the toilet paper 100 under a load of 50 gf/cm$^2$ is preferably less than or equal to 70%. Here, the compression ratio under the load of 50 gf/cm$^2$ is calculated according to a formula below based on the thickness (thickness under load) of the toilet paper 100 when the load of 50 gf/cm$^2$ is applied to the toilet paper 100 in the thickness direction and the initial thickness. Also, the initial thickness under the load of 50 gf/cm$^2$ indicates the thickness of the toilet paper immediately before the load of 50 gf/cm$^2$ is applied to the toilet paper in the thickness direction. The load of 50 gf/cm$^2$ is a pressure that is supposed to be applied when toilet paper is used (for example, for wiping).

$$\text{Compression ratio (\%)} = (\text{initial thickness} - \text{thickness under load})/\text{initial thickness} \times 100$$

Setting the physical characteristics of the toilet paper 100 as described above makes it possible to reliably obtain bulky toilet paper that is less likely to be flattened.

EXAMPLES

The present embodiment is further described below using examples. However, the present invention is not limited to those examples. The measurement and evaluation of examples and comparative examples were performed as described below.

[Basis Weight (Base Paper and Product)]

The basis weights (paper weights in gsm) (g/m$^2$) of crepe paper (base paper) and products of the toilet paper 100 used in tests were measured. The basis weights (paper weights in gsm) (g/m$^2$) were calculated according to JIS P 8124 (1998).

[Thickness (Base Paper)]

The thickness (μm/sheet) of base paper was measured. After a specimen of base paper cut into a 50 cm×50 cm size was sufficiently humidified under conditions specified by JIS P 8111 (1998), the thickness of the specimen was measured under the same conditions using a dial thickness gauge "PEACOCK TYPE G" (OZAKI MFG. CO., LTD). In an actual measurement procedure, after confirming that there is no dust or dirt between a plunger and a measurement table, the plunger is lowered onto the measurement table, and the scale of the dial thickness gauge is moved to adjust the zero point. Next, the plunger is raised, and the specimen is placed on the test table. Then, the plunger is slowly lowered, and the gauge is read. At this step, the plunger is simply placed on the specimen. The plunger has a circular end part that is made of a metal and has a diameter of 10 mm. The plunger is placed on the specimen such that a flat surface of the circular end part perpendicularly contacts the paper surface. When the thickness is 120 μm, the load applied to measure the thickness is about 70 gf. An average of ten measurements is used as the measurement of the thickness.

[Thickness (Product)]

The thickness of each product was measured (The thickness is measured in the state of a product. For example, the thickness of a 2-ply product is measured in the 2-ply state). After a specimen cut into a 12 cm×12 cm size was sufficiently humidified under conditions specified by JIS P 8111 (1998), the thickness of the specimen was measured under the same conditions using a dial thickness gauge "PEACOCK TYPE H" (OZAKI MFG. CO., LTD). In an actual measurement procedure, after confirming that there is no dust or dirt between a plunger and a measurement table, the plunger is lowered onto the measurement table, and the scale of the dial thickness gauge is moved to adjust the zero point. Next, the plunger is raised, and the specimen is placed on the test table. After opening the gauge head to 70 μm by moving the plunger, the lever is released at once, and the gauge is read. The plunger has a circular end part that is made of a metal and has a diameter of 10 mm. The plunger is placed on the specimen such that a flat surface of the circular end part perpendicularly contacts the paper surface. When the thickness is 120 μm, the load applied to measure the thickness is about 70 gf. An average of ten measurements is used as the measurement of the thickness.

[Compression Test]

Compression tests were performed on the toilet paper 100. In the compression test, a specimen cut into a 12 cm×12 cm size is prepared (The test is performed on toilet paper in the state of a product. For example, when the specimen is a 2-ply product, the test is performed on the specimen in the 2-ply state). Using a compression tester (KATO TECH CO., LTD., KES-G5), compression energy WC (gf·cm/cm$^2$) generated when a load of 500 gf/cm$^2$ is applied, an initial thickness $T_0$ (mm) under a load of 50 gf/cm$^2$, and a thickness $T_m$ (mm) after applying the load of 50 gf/cm$^2$ are measured. Also, a compression ratio (%) under the load of 50 gf/cm$^2$ is calculated based on the initial thickness $T_0$ (mm) and the thickness $T_m$ (mm). The measurement conditions are as follows: pressurizer area: 2 cm$^2$, dynamometer: 1 kg, CHECK switch: MES, DEF output sensitivity dial: 2 mm/V, upper limit load: (1) 50 gf/cm$^2$ (SENS: 2, STOROKE SET dial: 5), (2) 500 gf/cm$^2$ (SENS: 10, STOROKE SET dial: 10), SPEED: 0.02 cm/s (SPEED RANGE switch: 0.1, SPED SET switch: 2), CONTROL switch: INT, and STOP switch: OFF.

Here, the compression energy WC is an integral of a compression workload when the specimen is compressed up to the upper limit load. The initial thickness $T_0$ is the thickness of the specimen when the load pressure reaches 0.5 gf/cm$^2$, and the thickness $T_m$ under the load is the thickness of the specimen when the load pressure reaches the upper limit load (50 gf/cm$^2$). Each of the initial thickness $T_0$ and the thickness $T_m$ under the load is obtained by averaging three measurements. The compression ratio (flattening ratio) under the load is calculated based on the initial thickness $T_0$ and the thickness $T_m$ under the load. The compression ratio under the load is calculated using a formula below.

Compression ratio under load (%)=(initial thickness $T_0$−thickness $T_m$ under load)/initial thickness $T_0$×100

When the compression energy under a load of 500 gf/cm$^2$ is high, it indicates that the toilet paper is strong and durable (tough). Also, when the compression energy under a load of 500 gf/cm$^2$ is high, it indicates that the toilet paper is soft and is readily compressed. In this example, when the compression energy under a load of 500 gf/cm$^2$ is greater than or equal to 5.0 gf·cm/cm$^2$, the toilet paper is evaluated as being durable and soft.

Also, when the initial thickness $T_0$ under a load of 50 gf/cm$^2$ is large, it indicates that the toilet paper is bulky. In this example, when the initial thickness $T_0$ under the load of 50 gf/cm$^2$ is greater than or equal to 0.7 mm, the toilet paper is evaluated as being bulky.

Also, when the compression ratio under the load of 50 gf/cm$^2$ is low, it indicates that the toilet paper is not readily flattened in the thickness direction. In this example, when the compression ratio under the load of 50 gf/cm$^2$ is less than or equal to 70%, the toilet paper is evaluated as being not readily flattened.

[Water Absorption Test]

In a water absorption test, a penetration prevention rate (%) was calculated, and water absorbency was evaluated based on the penetration prevention rate (%). Specifically, 1 ml of distilled water is applied evenly by, for example, spraying to a 30 mm×40 mm area that is defined using, for example, a mending tape on a horizontally-held acrylic plate, and 15 specimens (number of specimens) are placed on the distilled water. Then, after uniformly applying a load of 650 g to the specimens for one second, the number of specimens into which the distilled water has penetrated is counted (penetration count). Here, the penetration count is obtained by averaging three measurements. Then, the penetration prevention rate (%) is calculated using a formula below.

Penetration prevention rate (%)=(number of specimens−penetration count)/basis weight of product×100

Here, when the penetration prevention rate is greater than or equal to 40%, it is evaluated that the toilet paper does not readily allow penetration of water to the back side even under a load and has good water absorbency.

Example 1

In Example 1, toilet paper 100 was prepared by stacking two sheets of base paper (crepe paper 10, 20) with a basis weight of 15.3 g/m$^2$ and a thickness of 131 μm in a nested manner as illustrated in FIGS. 2 through 4. Also, in Example 1, as illustrated in FIG. 2, embossments were arranged on the curves SC1 through SC4 each of which is a sine-wave curve that has an amplitude (the amplitude of the sine curve) of 40.0 mm and a period (the period or wavelength of the sine curve) of 209.3 mm. Other embossing conditions were as follows: area of top part of embossed protrusion: 1.2 mm$^2$/each, height of embossed protrusion: 1.4 mm, inclination angle of embossed protrusion: 70 degrees, shape of top part of embossed protrusion: quadrangle, number of embossed protrusions (front, crepe paper 10): 1110/144 cm$^2$, number of embossed protrusions (back, crepe paper 20): 1116/144 cm$^2$, area percentage of top parts of embossed protrusions (percentage of gluing area between non-embossed part 11 of crepe paper 10 and embossed protrusions 42 of crepe paper 20): 9.1%, volume of embossed protrusions (front, crepe paper 10): 3930 mm$^3$, volume of embossed protrusions (back, crepe paper 20): 3930 mm$^3$; volume of non-embossment space (volume of space excluding embossed protrusions): 12000 mm$^3$, and area percentage of non-embossed part: 70.8%. Also, in Example 1, the basis weight and the thickness of a product of the toilet paper 100 were 14.1 g/m$^2$ and 340 μm, respectively. The conditions and results of Example 1 are indicated in Table 1.

Example 2

In Example 2, as illustrated in FIG. 5, embossments were arranged on the curves SC1 through SC4 each of which is a sine-wave curve that has an amplitude of 40.0 mm and a period (wavelength) of 240.0 mm. Other embossing conditions were as follows: number of embossed protrusions (front, crepe paper 10): 1109/144 cm$^2$, number of embossed protrusions (back, crepe paper 20): 1110/144 cm$^2$, area percentage of top parts of embossed protrusions (percentage of gluing area between non-embossed part 11 of crepe paper 10 and embossed protrusions 42 of crepe paper 20): 9.0%, volume of embossed protrusions (front, crepe paper 10): 3877 mm$^3$, volume of embossed protrusions (back, crepe paper 20): 3879 mm$^3$, volume of non-embossment space: 12404 mm$^3$, and area percentage of non-embossed part: 70.4%. Also, in Example 2, the basis weight and the thickness of a product of the toilet paper 100 were 14.1 g/m$^2$ and 332 μm, respectively. Other conditions were substantially the same as those in Example 1. The conditions and results of Example 2 are indicated in Table 1.

Comparative Example 1

Figure 6:
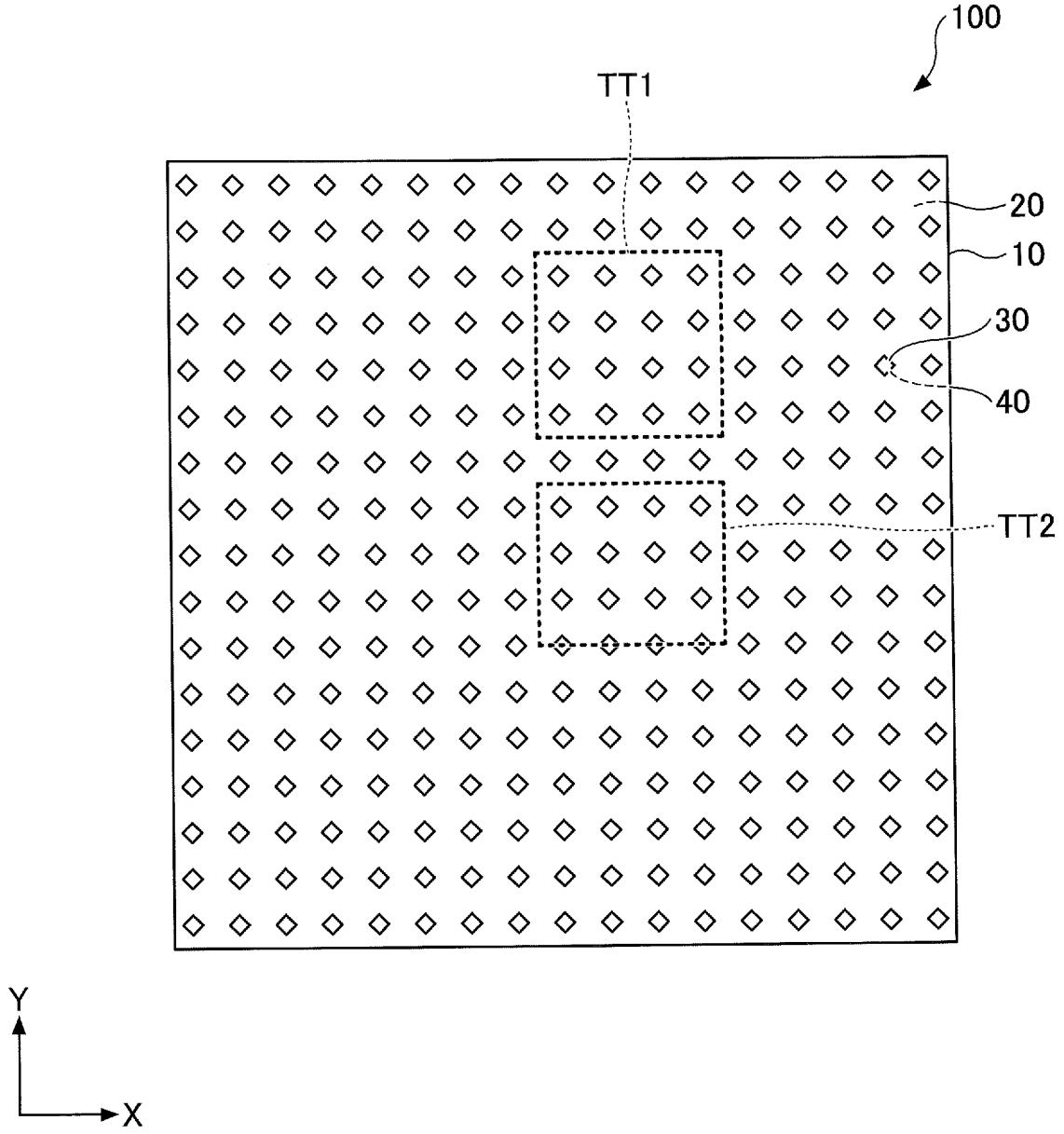
FIG. 6 is a drawing illustrating sheets of crepe paper constituting related-art toilet paper having a tip-to-tip structure (Comparative Example 1)
Figure 7:
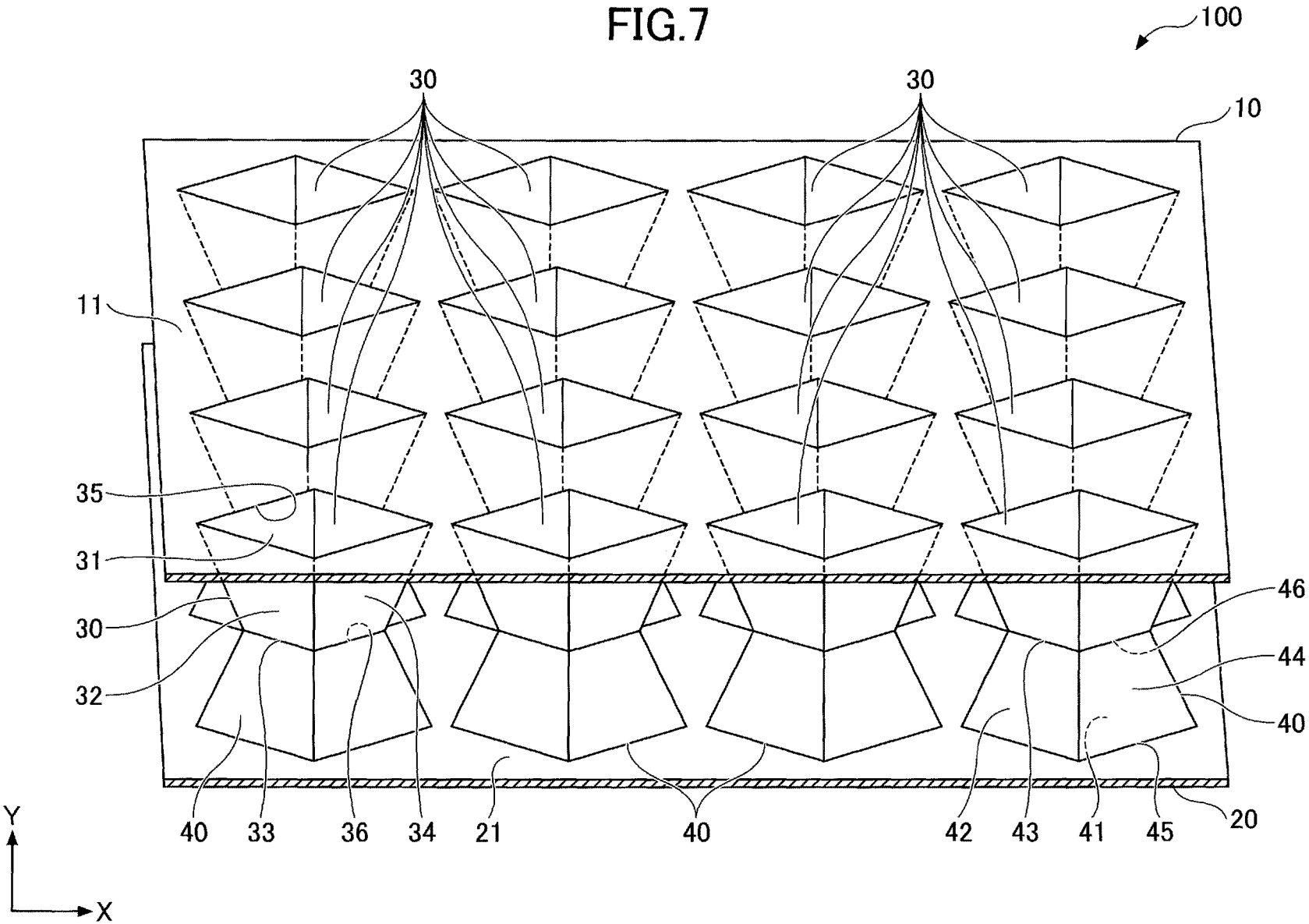
FIG. 7 is an enlarged perspective cross-sectional view of a portion (TT1) of FIG. 6.
Figure 8:
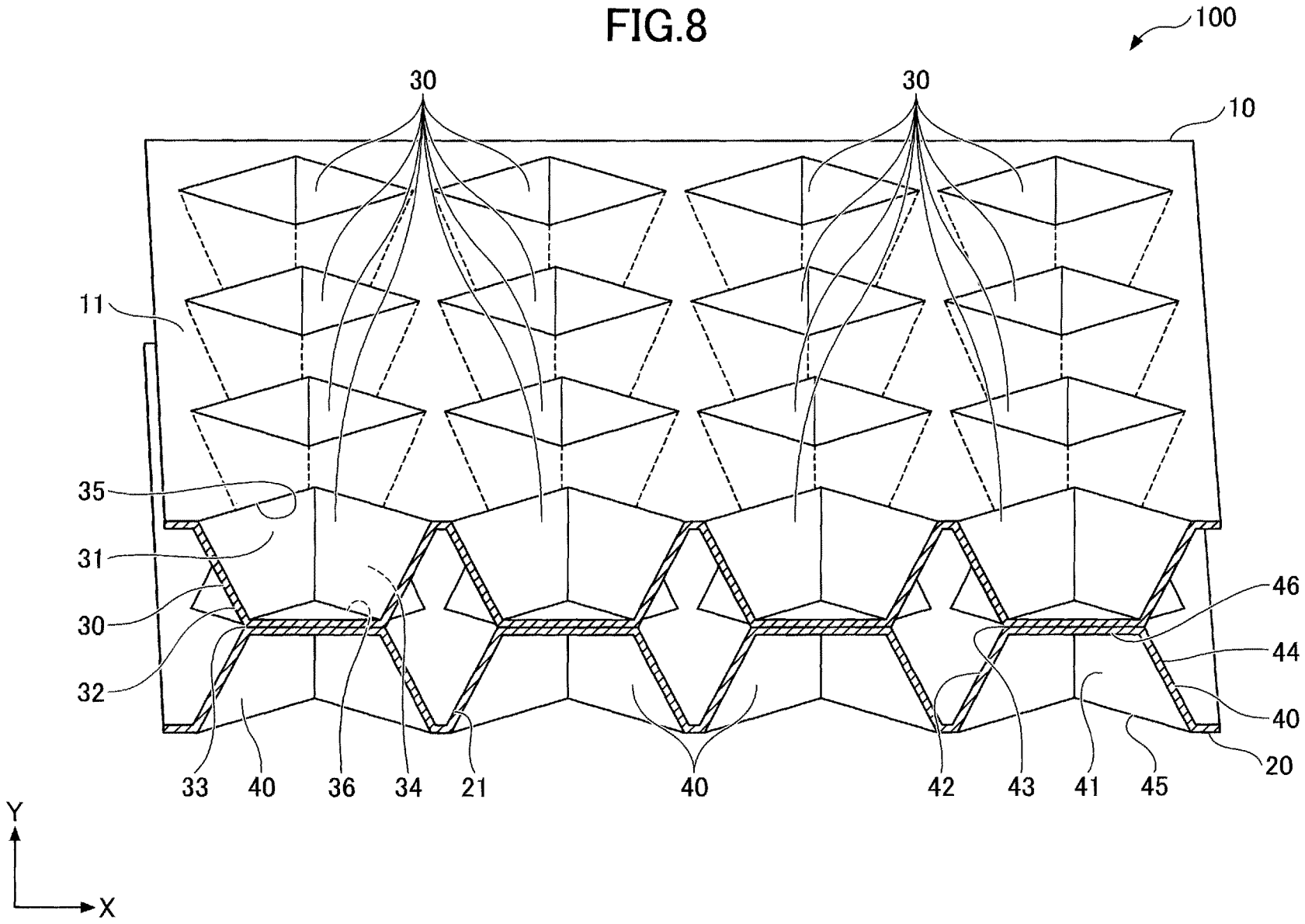
FIG. 8 is an enlarged perspective cross-sectional view of a portion (TT2) of FIG. 6.

In Comparative Example 1, toilet paper 100 was prepared by stacking two sheets of base paper (crepe paper 10, 20) in a tip-to-tip manner as illustrated in FIGS. 6 through 8. Also, in Comparative Example 1, as illustrated in FIGS. 6 through 8, all embossments were arranged linearly. Other embossing conditions were as follows: number of embossed protrusions (front, crepe paper 10): 1156/144 cm$^2$, number of embossed protrusions (back, crepe paper 20): 1156/144 cm$^2$, area percentage of top parts of embossed protrusions (percentage of gluing area between embossed protrusions of crepe paper 10 and embossed protrusions of crepe paper 20): 9.0%, volume of embossed protrusions (front, crepe paper 10): 3883 mm$^3$, volume of embossed protrusions (back, crepe paper 20): 3882 mm$^3$, volume of non-embossment space: 12395 mm$^3$, and area percentage of non-embossed part: 68.7%. In Comparative Example 1, the basis weight and the thickness of a product of the toilet paper 100 were 14.1 g/m$^2$ and 258 μm, respectively. Other conditions were substantially the same as those in Example 1. The conditions and results of Comparative Example 1 are indicated in Table 1.

Reference Example 1

Figure 9:
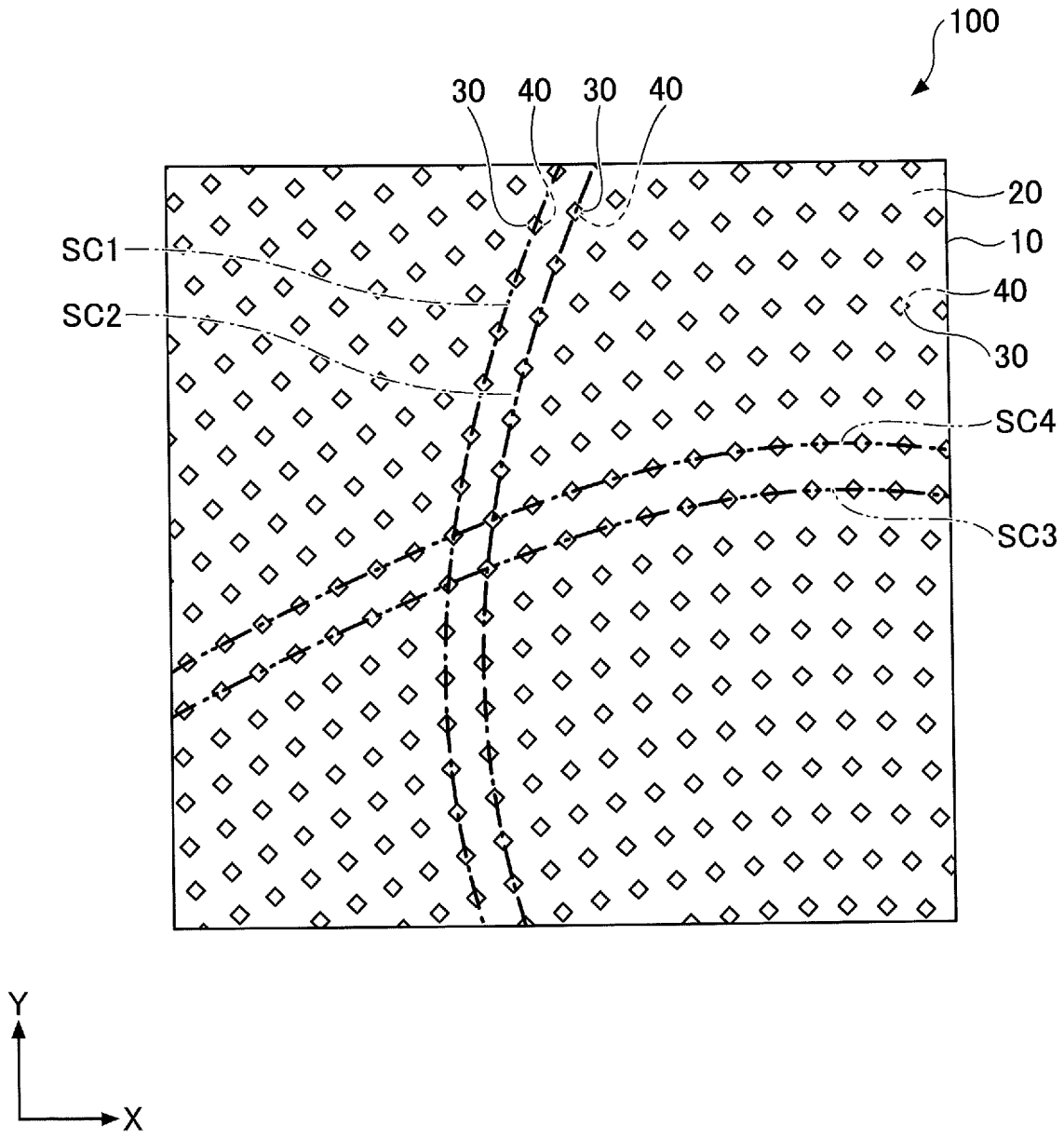
FIG. 9 is a drawing illustrating sheets of crepe paper that constitute toilet paper having a tip-to-tip structure and on which embossments are arranged along sine-wave curves (Reference Example 1)

In Reference Example 1, toilet paper 100 was prepared by stacking two sheets of base paper (crepe paper 10, 20) in a tip-to-tip manner as illustrated in FIG. 9. Also, in Reference Example 1, as illustrated in FIG. 9, embossments were arranged on the curves SC1 through SC4 each of which is a sine-wave curve that has an amplitude of 40.0 mm and a period (wavelength) of 240.0 mm. Other embossing conditions were as follows: number of embossed protrusions (front, crepe paper 10): 1109/144 $cm^2$, number of embossed protrusions (back, crepe paper 20): 1109/144 $cm^2$, area percentage of top parts of embossed protrusions (percentage of gluing area between embossed protrusions of crepe paper 10 and embossed protrusions of crepe paper 20): 9.0%, volume of embossed protrusions (front, crepe paper 10): 3877 $mm^3$, volume of embossed protrusions (back, crepe paper 20): 3877 $mm^3$, volume of non-embossment space: 12406 $mm^3$, and area percentage of non-embossed part: 70.4%. In Reference Example 1, the basis weight and the thickness of a product of the toilet paper 100 were 14.0 $g/m^2$ and 258 μm, respectively. Other conditions were substantially the same as those in Example 1. The conditions and results of Reference Example 1 are indicated in Table 1.

Reference Example 2

Figure 10:
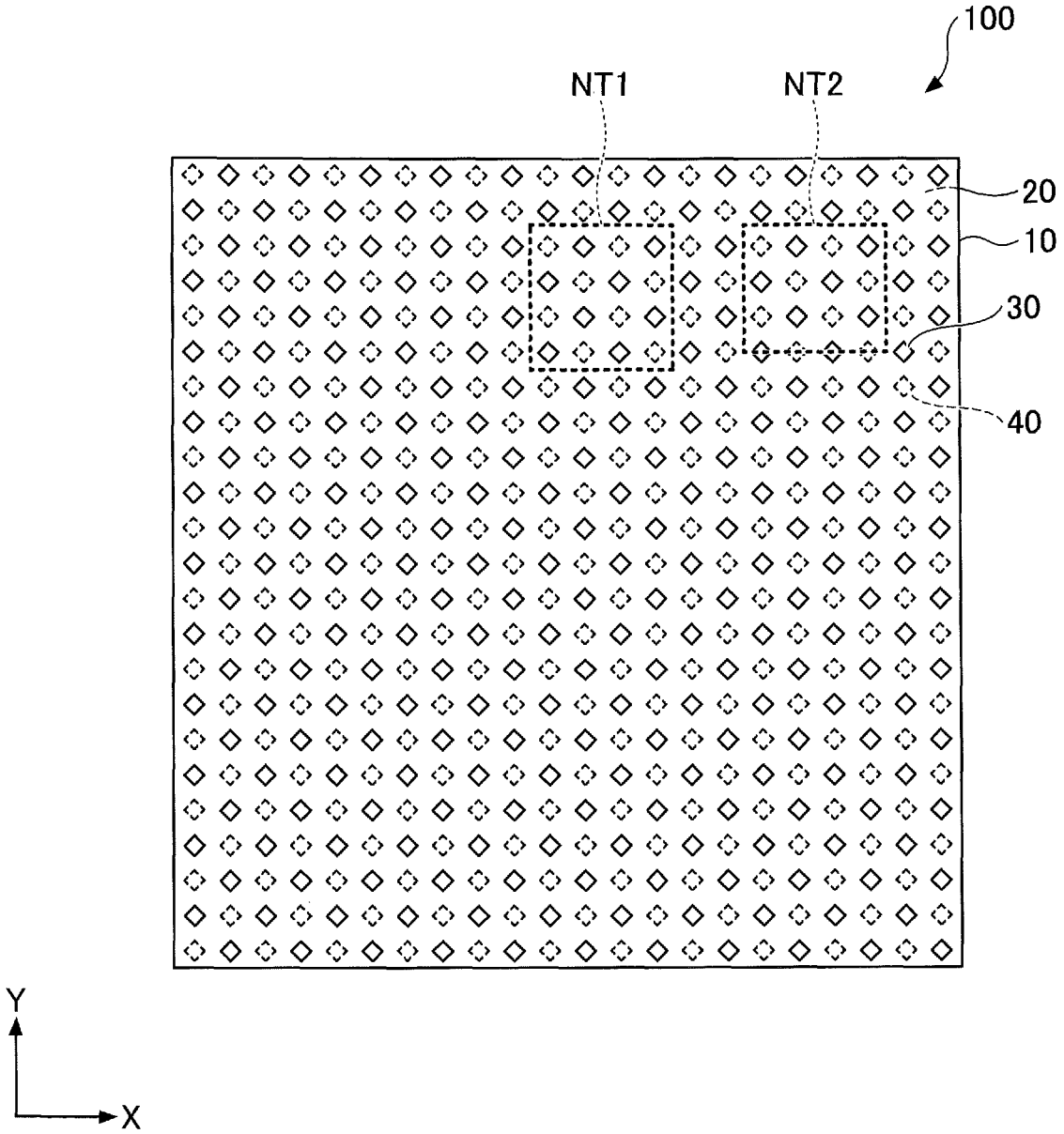
FIG. 10 is a drawing illustrating sheets of crepe paper constituting toilet paper having a nested structure (Reference Example 2)
Figure 11:
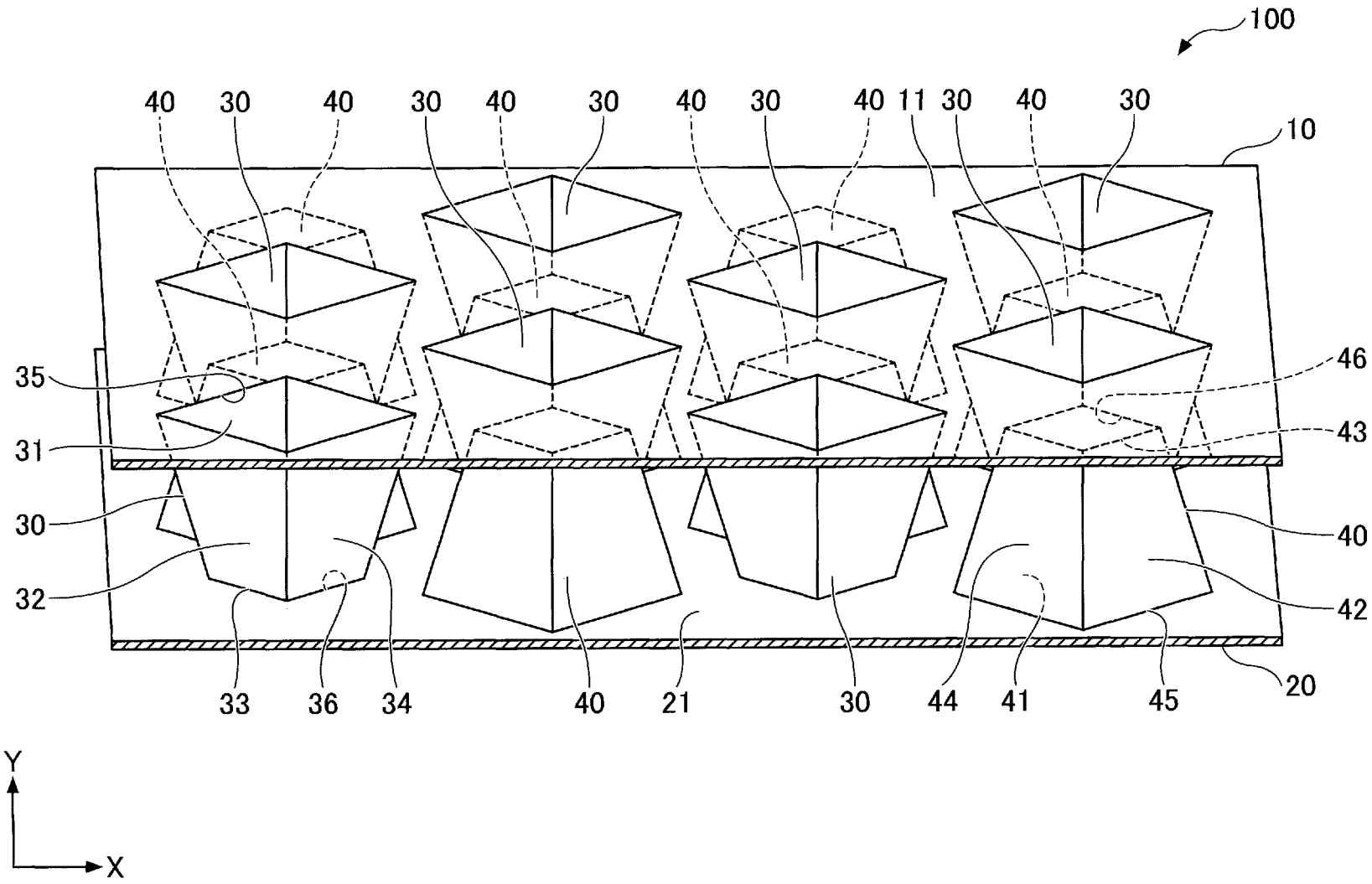
FIG. 11 is an enlarged perspective cross-sectional view of a portion (NT1) of FIG. 10.
Figure 12:
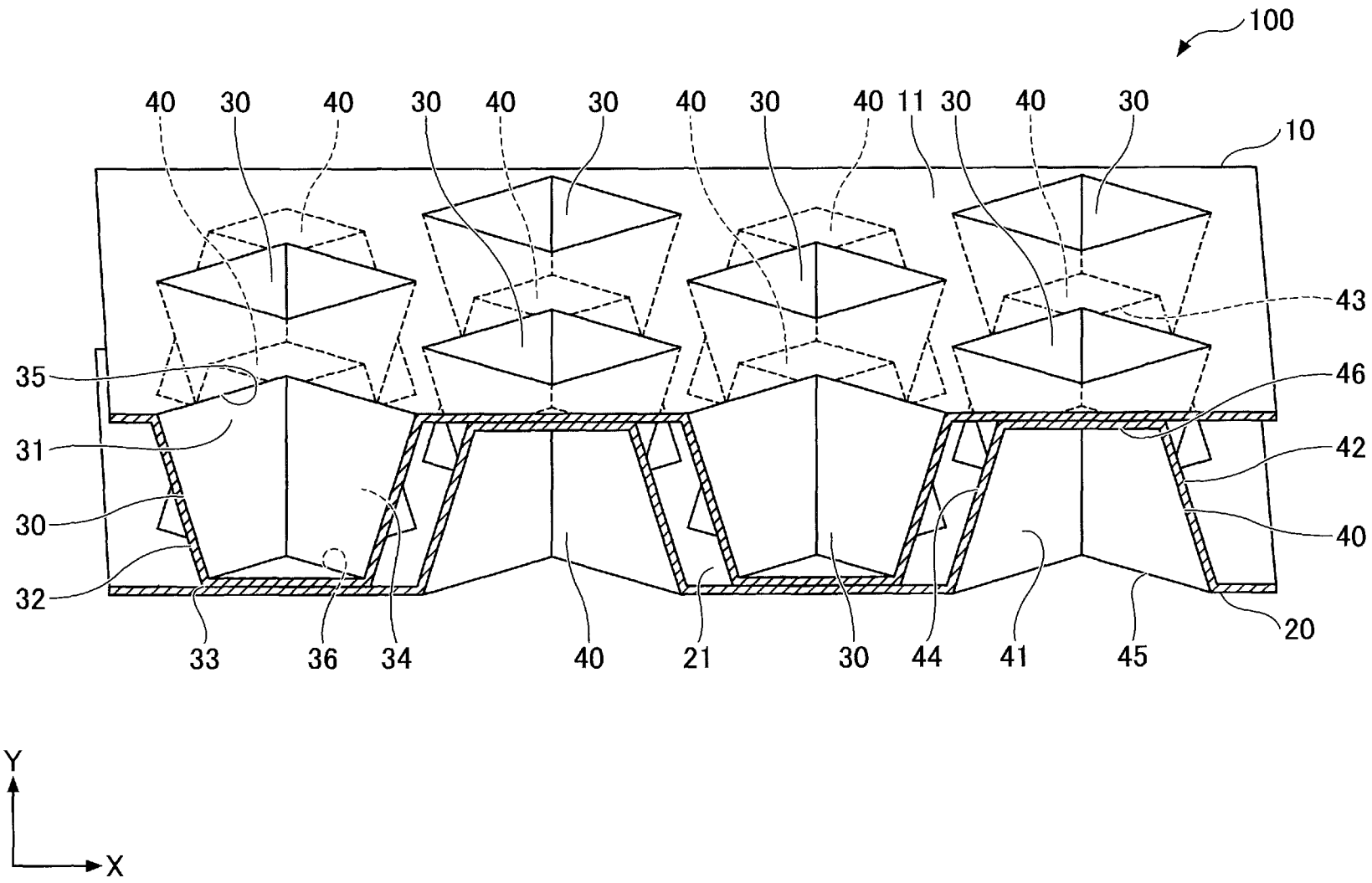
FIG. 12 is an enlarged perspective cross-sectional view of a portion (NT2) of FIG. 10.

In Reference Example 2, toilet paper 100 was prepared by stacking two sheets of base paper (crepe paper 10, 20) in a nested manner as illustrated in FIGS. 10 through 12. Also, in Reference Example 2, as illustrated in FIGS. 10 through 12, all embossments were arranged linearly. Other embossing conditions were as follows: number of embossed protrusions (front, crepe paper 10): 1013/144 $cm^2$, number of embossed protrusions (back, crepe paper 20): 1012/144 $cm^2$, area percentage of top parts of embossed protrusions (percentage of gluing area between non-embossed part 11 of crepe paper 10 and embossed protrusions 42 of crepe paper 20): 8.0%, volume of embossed protrusions (front, crepe paper 10): 3461 $mm^3$, volume of embossed protrusions (back, crepe paper 20): 3461 $mm^3$, volume of non-embossment space: 13238 $mm^3$, and area percentage of non-embossed part: 72.1%. In Reference Example 2, the basis weight and the thickness of a product of the toilet paper 100 were 14.2 $g/m^2$ and 404 μm, respectively. Other conditions were substantially the same as those in Example 1. The conditions and results of Reference Example 2 are indicated in Table 1.

Reference Example 3

Figure 13:
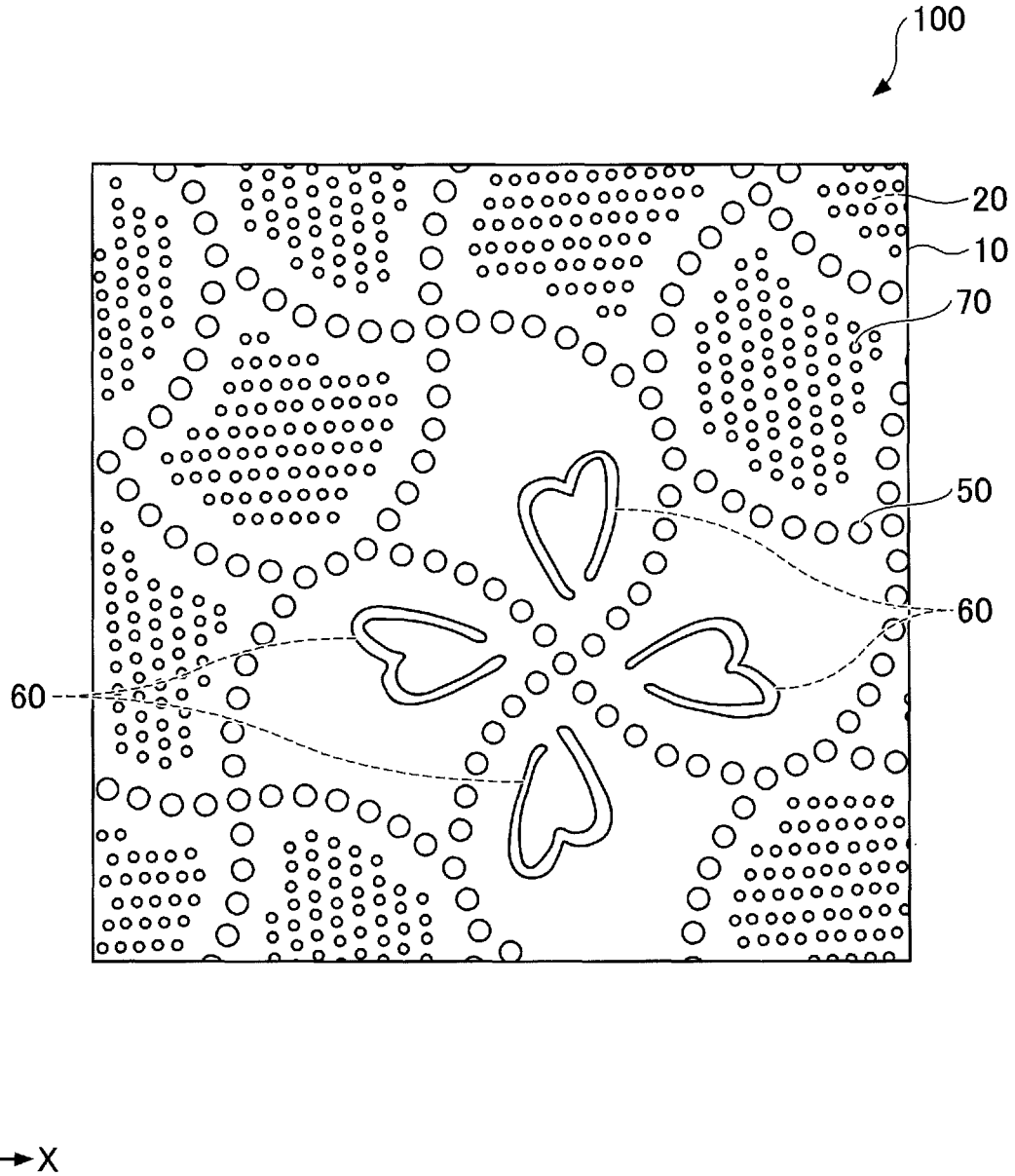
FIG. 13 is a drawing illustrating sheets of crepe paper constituting toilet paper having a design-laminated structure (Reference Example 3).

In Reference Example 3, toilet paper 100 with a design-laminated structure was prepared by stacking two sheets of base paper (crepe paper 10, 20) with a basis weight of 15.5 $g/m^2$ and a thickness of 133 μm as illustrated in FIG. 13. Top parts of embossed protrusions of embossments 50 and 70 of the crepe paper were formed in circular shapes, and top parts of embossed protrusions of embossments 60 of the crepe paper 20 were formed in a floral design. Also, in Reference Example 3, the basis weight and the thickness of a produce of the toilet paper 100 were 15.1 $g/m^2$ and 199 μm, respectively. The conditions and results of Reference Example 3 are indicated in Table 1.

TABLE 1

| | | | EXAMPLE 1 | EXAMPLE 2 | COMPARATIVE EXAMPLE 1 | REFERENCE EXAMPLE 1 | REFERENCE EXAMPLE 2 | REFERENCE EXAMPLE 3 |
|---|---|---|---|---|---|---|---|---|
| BASE PAPER | BASIS WEIGHT | ($g/m^2$) | 15.3 | 15.3 | 15.3 | 15.3 | 15.3 | 15.5 |
| | THICKNESS | (μm) | 131 | 131 | 131 | 131 | 131 | 333 |
| EMBOSSING CONDITIONS | LAMINATED STRUCTURE | | nested | nested | tip to tip | tip to tip | nested | DESIGN LAMINATE |
| | NUMBER OF PLIES | (NUMBER) | 2 | 2 | 2 | 2 | 2 | 2 |
| | AMPLITUDE OF SINE CURVE | (mm) | 40.0 | 40.0 | — | 40.0 | — | — |
| | PERIOD OF SINE CURVE | (mm) | 209.3 | 240.0 | — | 240.0 | — | — |
| | AREA OF TOP PART OF EMBOSSED PROTRUSION | ($mm^2$/EACH) | 1.2 | 1.2 | 1.2 | 1.2 | 1.2 | — |
| | HEIGHT OF EMBOSSED PROTRUSION | (mm) | 1.4 | 1.4 | 1.4 | 1.4 | 1.4 | — |
| | INCLINATION ANGLE OF EMBOSSED PROTRUSION | (°) | 70 | 70 | 70 | 70 | 70 | — |
| | SHAPE OF TOP PART OF EMBOSSED PROTRUSION | | QUADRANGLE | QUADRANGLE | QUADRANGLE | QUADRANGLE | QUADRANGLE | CIRCULAR SHAPE, FLORAL DESIGN |
| | NUMBER OF EMBOSSMENTS: FRONT | (NUMBER/144 $cm^{2)}$ | 1110 | 1109 | 1156 | 1109 | 1013 | — |
| | NUMBER OF EMBOSSMENTS: BACK | (NUMBER/144 $cm^{2)}$ | 1116 | 1110 | 1156 | 1109 | 1012 | — |
| | AREA PERCENTAGE OF TOP PARTS OF EMBOSSED PROTRUSIONS (GLUING AREA PERCENTAGE) | (%) | 9.1 | 9.0 | 9.0 | 9.0 | 8.0 | — |
| | VOLUME OF EMBOSSED PROTRUSIONS: FRONT | ($mm^3$) | 3930 | 3877 | 3883 | 3877 | 3461 | — |
| | VOLUME OF EMBOSSED PROTRUSIONS: BACK | ($mm^3$) | 3930 | 3879 | 3882 | 3877 | 3461 | — |
| | VOLUME OF NON-EMBOSSMENT SPACE (VOLUMES OF SPACE EXCLUDING EMBOSSED PROTRUSIONS) | ($mm^3$) | 12000 | 12404 | 12395 | 12406 | 13238 | — |
| | AREA PERCENTAGE OF NON-EMBOSSED PART | (%) | 70.8 | 70.4 | 68.7 | 70.4 | 72.1 | — |
| PRODUCT | BASIS WEIGHT | ($g/m^2$) | 14.1 | 14.1 | 14.1 | 14.0 | 14.2 | 15.1 |
| | THICKNESS | (μm) | 340 | 332 | 258 | 258 | 404 | 199 |
| COMPRESSION TEST (LOAD: 500 $gf/cm^2$) | COMPRESSION ENERGY WC | ($gf \cdot cm/cm^2$) | 6.48 | 5.52 | 3.08 | 3.81 | 4.59 | 3.57 |
| COMPRESSION TEST (LOAD: 50 $gf/cm^2$) | INITIAL THICKNESS TO | (mm) | 0.72 | 0.73 | 1.01 | 1.16 | 0.71 | 0.49 |
| | THICKNESS AFTER APPLYING LOAD Tm | (mm) | 0.40 | 0.41 | 0.24 | 0.32 | 0.38 | 0.25 |
| | COMPRESSION RATIO (T0-Tm)/T0 | (%) | 43.8 | 43.4 | 75.9 | 72.9 | 46.5 | 49.0 |
| WATER ABSORPTION TEST | WATER ABORBENCY | (%) | 44.7 | 44.7 | 39.7 | 39.3 | 43.0 | 37.7 |

Referring to Table 1, in Examples 1 and 2, the compression energy under a load of 500 gf/cm$^2$ is greater than or equal to 5.0 gf·cm/cm$^2$. Also, the compression ratio under a load of 50 gf/cm$^2$ is less than or equal to 70%. Further, the water absorbency (penetration prevention rate) is greater than or equal to 40%.

On the other hand, in Comparative Example 1 and Reference Example 1, the compression energy under a load of 500 gf/cm$^2$ is less than 5.0 gf·cm/cm$^2$. Also, the compression ratio under a load of 50 gf/cm$^2$ is greater than 70%. Further, the water absorbency (penetration prevention rate) is less than 40%.

In Reference Example 2 and Reference Example 3, the compression energy under a load of 500 gf/cm$^2$ is less than 5.0 gf·cm/cm$^2$. Also, the compression ratio under a load of 50 gf/cm$^2$ is less than or equal to 70%. Further, the water absorbency (penetration prevention rate) in Reference Example 2 is greater than or equal to 40%, and the water absorbency in Reference Example 3 is less than 40%.

The above results indicate that with the related-art tip-to-tip structure, regardless of whether the embossments are arranged linearly or in sine-wave shapes, it is not possible to increase the strength of toilet paper and to obtain soft toilet paper, and the resulting toilet paper is easily flattened and has poor water absorbency (Comparative Example 1 and Reference Example 1). Also, the strength of toilet paper with a nested structure where the embossments are arranged linearly (Reference Example 2) cannot be increased to a level corresponding to the strength of toilet paper in Example 1 and Example 2. Further, with the related-art design-laminated structure (Reference Example 3), it is not possible to increase the strength of toilet paper and to obtain toilet paper with sufficient water absorbency.

On the other hand, with the configuration where the crepe paper 10 and the crepe paper 20 are joined together such that the surface having the embossed protrusions 32 and the surface having the embossed protrusions 42 face each other in a nested manner and where the embossments 30 and the embossments 40 are arranged on sine-wave curves, the toilet paper 100 has high strength, is readily compressible, is not readily flattened in the thick direction, and has high water absorbency. This result indicates that the present embodiment (Examples 1 and 2) makes it possible to obtain the toilet paper 100 that is durable (strong) and soft, is not readily flattened, and has excellent water absorbency.

Preferred embodiments of the present invention are described above. However, the present invention is not limited to the specifically disclosed embodiments, and variations and modifications may be made without departing from the scope of the present invention.

The present international application claims priority to Japanese Patent Application No. 2017-128581, filed on Jun. 30, 2017, the entire contents of which are hereby incorporated herein by reference.

EXPLANATION OF REFERENCE NUMERALS

100 Toilet paper
10 Crepe paper
20 Crepe paper
30 Embossment
31 Embossed recess
32 Embossed protrusion
33 Top part
34 Side surface
35 Opening
40 Embossment
41 Embossed recess
42 Embossed protrusion
43 Top part
44 Side surface
45 Opening
SC1 curve
SC2 curve
SC3 curve
SC4 curve

The invention claimed is:

1. Toilet paper, comprising:

a first sheet on which first embossments are formed, the first sheet including a first inner surface and a first outer surface;

a second sheet on which second embossments are formed, the second sheet including a second inner surface and a second outer surface, and the first sheet and the second sheet being laminated integrally in a nested manner in which the first inner surface of the first sheet and the second inner surface of the second sheet face each other, wherein at least some embossments in the first embossments are arranged on a first curve having a sine-wave shape;

at least some embossments in the second embossments are arranged on a second curve having a sine-wave shape, the second curve being different from the first curve and parallel to the first curve;

at least some embossments in one of the first embossments and the second embossments are arranged on a third curve having a sine-wave shape, the third curve intersecting the first curve and extending from one lateral end to another lateral end of the toilet paper;

each first embossment arranged on the first curve and on the third curve protrudes toward the second inner surface of the second sheet; and each second embossment arranged on the second curve and on the third curve protrudes toward the first inner surface of the first sheet.

2. The toilet paper as claimed in claim 1, wherein at least some embossments in one of the first embossments and the second embossments are arranged on a fourth curve having a sine-wave shape, the fourth curve being parallel to the third curve.

3. The toilet paper as claimed in claim 1, wherein an amplitude of the sine-wave shape is between 10 mm and 60 mm.

4. The toilet paper as claimed in claim wherein 1, wherein a period of the sine-wave shape is between 50 mm and 300 mm.

5. The toilet paper as claimed in claim 1, wherein at least one of an area of each of top parts of first embossed protrusions of the first embossments and an area of each of top parts of second embossed protrusions of the second embossments is between 0.8 mm$^2$ and 1.5 mm$^2$.

6. The toilet paper as claimed in claim 1, wherein at least one of an area percentage of top parts of first embossed protrusions of the first embossments and an area percentage of top parts of second embossed protrusions of the second embossments is between 5% and 10%.

7. The toilet paper as claimed in claim 1, wherein at least one of an area of each of top parts of first embossed protrusions of the first embossments and an area of each of top parts of second embossed protrusions of the second embossments is between 0.8 mm$^2$ and 1.5 mm$^2$;

at least one of an area percentage of the top parts of the first embossed protrusions and an area percentage of the top parts of the second embossed protrusions is between 5% and 10%; and at least one of a height of the first embossed protrusions and a height of the second embossed protrusions is between 1.0 mm and 1.7 mm.

8. The toilet paper as claimed in claim 1, wherein a side surface of a first embossed protrusion of each of the first embossments is inclined from the first sheet toward a top part of the first embossed protrusion such that an area of the top part of the first embossed protrusion becomes less than an area of an opening of a first embossed recess corresponding to the first embossed protrusion; and a side surface of a second embossed protrusion of each of the second embossments is inclined from the second sheet toward a top part of the second embossed protrusion such that an area of the top part of the second embossed protrusion becomes less than an area of an opening of a second embossed recess corresponding to the second embossed protrusion.

9. The toilet paper as claimed in claim 1, wherein a side surface of a first embossed protrusion of each of the first embossments is inclined from the first sheet toward a top part of the first embossed protrusion such that an area of the top part of the first embossed protrusion becomes less than an area of an opening of a first embossed recess corresponding to the first embossed protrusion;

a side surface of a second embossed protrusion of each of the second embossments is inclined from the second sheet toward a top part of the second embossed protrusion such that an area of the top part of the second embossed protrusion becomes less than an area of an opening of a second embossed recess corresponding to the second embossed protrusion; and an inclination angle of each of the side surface of the first embossed protrusion and the side surface of the second embossed protrusion is between 60 degrees and 80 degrees.

10. The toilet paper as claimed in claim 1, wherein a compression strength of the toilet paper under a load of 500 $gf/cm^2$ is greater than or equal to 5.0 $gf \cdot cm/cm^2$.

11. The toilet paper as claimed in claim 1, wherein a compression ratio of the toilet paper under a load of 50 $gf/cm^2$ is less than or equal to 70%.

12. The toilet paper as claimed in claim 1, wherein on the third curve, some of the first embossments and some of the second embossments are arranged alternately.

* * * * *